US011142879B1

(12) United States Patent
Lovell, Jr.

(10) Patent No.: US 11,142,879 B1
(45) Date of Patent: Oct. 12, 2021

(54) POST INSTALLATION APPARATUS

(71) Applicant: Howard Louis Lovell, Jr., Athens, AL (US)

(72) Inventor: Howard Louis Lovell, Jr., Athens, AL (US)

( * ) Notice: Subject to any disclaimer, the term of this patent is extended or adjusted under 35 U.S.C. 154(b) by 37 days.

(21) Appl. No.: 16/100,652

(22) Filed: Aug. 10, 2018

Related U.S. Application Data

(60) Provisional application No. 62/543,583, filed on Aug. 10, 2017.

(51) Int. Cl.
*E02D 7/16* (2006.01)
*E04H 17/26* (2006.01)

(52) U.S. Cl.
CPC ..... *E02D 7/16* (2013.01); *E04H 17/263* (2013.01)

(58) Field of Classification Search
CPC .. E02D 7/16; E02D 7/14; E02D 13/04; E04H 17/263
USPC ..... 173/90
See application file for complete search history.

(56) References Cited

U.S. PATENT DOCUMENTS 20,883 A * 7/1858 Loveless ..... E21B 7/025 173/185
95,786 A * 10/1869 Flad ..... E02D 7/04 173/53
129,083 A * 7/1872 Baldwin ..... E21B 7/02 173/39
205,244 A * 6/1878 Cavanagh ..... B25D 1/16 173/90
274,989 A * 4/1883 John ..... E21B 7/02 173/42
281,848 A * 7/1883 Dixon ..... E21B 7/02 173/42
293,021 A * 2/1884 Hiatt ..... E04H 17/263 173/42
299,344 A * 5/1884 Cavanagh ..... B25D 1/16 173/90
387,369 A * 8/1888 Schaaf ..... E21B 7/02 173/42
785,899 A * 3/1905 Lawler ..... E21B 7/122 175/10
897,451 A * 9/1908 Baldwin ..... B25D 17/005 173/29

(Continued)

*Primary Examiner* — Thanh K Truong
*Assistant Examiner* — Katie L Gerth
(74) *Attorney, Agent, or Firm* — Angela Holt; Andrew Tuggle; Bradley Arant Boult Cummings LLP

(57) ABSTRACT

Post installation apparatuses are disclosed that decrease the length of a post subject to buckling so that more force can be applied when installing a post in the ground. In one embodiment, a post installation apparatus includes a frame that defines an elongated vertical passage configured to receive a post such that the post vertically extends through the elongated vertical passage when the elongated vertical passage receives the post. The frame provides the structural support so that a post secured to the frame does not buckle. To allow for easy removal of the post, the elongated vertical passage defines an elongated vertical opening in the frame such that the post is removable through the elongated vertical opening. The post installation apparatus also includes one or more securement devices that are configured to be positioned across the elongated vertical opening so as to secure the post in the elongated vertical passage.

20 Claims, 15 Drawing Sheets

(56) References Cited

U.S. PATENT DOCUMENTS 915,788 A * 3/1909 Murphy ..... E04H 17/263 173/42
1,477,568 A * 12/1923 Lancaster ..... E02D 5/16 173/85
1,569,857 A * 1/1926 Farbcarla ..... E04H 17/263 405/244
2,040,668 A * 5/1936 Nichols ..... E02D 7/16 173/25
2,134,989 A * 11/1938 Templeton ..... E02D 7/08 173/37
2,192,091 A * 2/1940 Millam ..... E02D 7/16 52/120
2,193,293 A * 3/1940 Nichols ..... E02D 7/16 173/25
2,225,765 A * 12/1940 Brice ..... E04H 17/263 173/126
2,348,820 A * 5/1944 Jordan ..... E04H 17/263 173/53
2,792,689 A * 5/1957 Phares ..... E04H 17/263 173/185
2,844,006 A * 7/1958 Lutz Mac W ..... E04H 17/263 173/124
3,019,608 A * 2/1962 Marmion ..... E02D 13/10 405/232
3,067,657 A * 12/1962 Wiekhorst ..... E01C 23/124 404/133.2
3,117,635 A * 1/1964 Deerkoski ..... E04H 17/263 173/28
3,499,497 A 3/1970 Moore
3,605,912 A * 9/1971 Fisher ..... E02D 7/16 173/189
3,888,317 A * 6/1975 Walters ..... E02D 7/16 173/193
3,934,655 A * 1/1976 Whistle ..... B65H 49/32 173/46
3,937,286 A * 2/1976 Wagner ..... B25D 11/10 173/203
4,002,210 A * 1/1977 White ..... E02D 7/08 173/26
4,439,056 A * 3/1984 Reilly ..... E01C 23/124 173/90
4,561,636 A * 12/1985 Moreland ..... E04H 17/263 254/29 R
4,790,392 A * 12/1988 Clements ..... B25D 1/16 173/128
4,989,677 A * 2/1991 Lam ..... E02D 5/523 173/1
5,020,605 A 6/1991 Leishman
5,104,265 A * 4/1992 Halloran, Jr. ..... E04H 12/2215 405/244
5,273,124 A * 12/1993 Lloyd ..... E21B 3/02 173/185
5,392,866 A * 2/1995 White ..... E02D 7/02 173/132
6,047,771 A * 4/2000 Røynestad ..... E21B 19/084 166/77.52
6,349,777 B1 * 2/2002 Burenga ..... E04H 17/263 173/187
6,591,919 B1 * 7/2003 Herrmann ..... E02D 7/10 173/184
6,702,037 B1 * 3/2004 Thiessen ..... E02D 7/10 173/131
6,889,777 B2 * 5/2005 Boley ..... E04H 17/263 173/112
7,597,156 B1 * 10/2009 Reid ..... E04H 17/263 173/171
2004/0026095 A1 2/2004 Kleinert
2005/0039933 A1 * 2/2005 Carter ..... A01G 17/16 173/1
2006/0113444 A1 * 6/2006 Parsons ..... E04H 17/263 248/274.1
2006/0213676 A1 * 9/2006 Jinnings ..... E02D 7/10 173/184
2007/0039748 A1 * 2/2007 Kennett ..... E02D 7/02 173/117
2009/0252558 A1 * 10/2009 Masters ..... E21B 41/04 405/195.1
2011/0113929 A1 5/2011 Lemelin
2013/0112447 A1 * 5/2013 Rohrer, Jr. ..... E04H 17/26 173/90
2015/0197961 A1 * 7/2015 Burenga ..... E04H 17/263 173/202
2016/0130777 A1 * 5/2016 Stam ..... E02D 7/02 405/228
2016/0326770 A1 * 11/2016 Breeden, III ..... E04H 17/263
2017/0204633 A1 * 7/2017 Hubener ..... E04H 17/263

* cited by examiner

POST INSTALLATION APPARATUS

RELATED APPLICATIONS

This application claims the benefit of provisional patent application Ser. No. 62/543,583, filed Aug. 10, 2017, the disclosure of which is hereby incorporated herein by reference in its entirety.

BACKGROUND

Post are often utilized in farming, construction, and roadways to build different types of structures (e.g., fences). These posts often need to have a bottom segment installed in the ground. Currently, post are often installed in the ground by humans using sled hammers. In other circumstances, post are installed in the ground with equipment such as tractors, track hoes, back hoes. Unfortunately, post are subject to buckling when being forced into the ground. More specifically, buckling is characterized by a sudden sideways deformation of the post when a post is subjected to compressive force. If a post buckles, the post may break or may permanently bend. Thus, the amount of compressive force that can be applied to a post is limited by the amount of buckling a post can tolerate before the post is damaged. Furthermore, it is often cumbersome to remove posts from the devices used by tractors, track hoes, backhoes after installation.

Thus, post installation equipment is needed that allows for more force to be applied to a post without damaging the post. Furthermore, post installation equipment is needed that allows for a post to be more easily removed from the post installation equipment.

SUMMARY

Post installation apparatuses are disclosed along with methods of using the same. The post installation apparatuses decrease the length of a post subject to buckling and thus allow for more force to be applied when installing a post in the ground. In one embodiment, a post installation apparatus includes a frame that defines an elongated vertical passage configured to receive a post such that the post vertically extends through the elongated vertical passage when the elongated vertical passage receives the post. The frame provides the structural support so that a post secured to the frame does not buckle. To allow for easy removal of the post, the elongated vertical passage defines an elongated vertical opening in the frame such that the post is removable through the elongated vertical opening. This allows for the post to be easily removed from the post installation apparatus after the post has been installed. The post installation apparatus also includes one or more securement devices that are configured to be positioned across the elongated vertical opening so as to secure the post in the elongated vertical passage.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

This disclosure relates to post installation apparatuses and methods of installing different types of posts using the same. The post installation apparatus may include a frame that defines an elongated vertical passage configured to receive a post. In this manner, the post vertically extends through the elongated vertical passage so that a segment of the post is enclosed by the post installation apparatus while a (generally shorter) segment of the post extends out of the post installation apparatus so that the post installation apparatus can be used to install the post in the ground. The structural framework of the frame prevents the portion of the posts secured by the frame from buckling or bending when the post is forced into the ground. In this manner, much more force can be used to install post in the ground. The post installation apparatuses may thus allow mechanized equipment to be used to install the post without the post bending or buckling.

It should be noted that while the specific embodiments described herein are used to install a T-post, a round post, and a sign post, the design of the post installation apparatus may be adjusted and modified to install any type of post including but not limited to but are not limited to, T-Post, round tubular post, solid post, rods, and sign post. Furthermore, the post installation apparatuses may be formed from a variety of techniques and or materials including (but not limited to) metal fabrication, extruded metal, injected molded resin, plastic, carbon fiber, and/or hand laid fiberglass.

Securement devices are used to secure the posts in the structural framework of the frames. Nonlimiting examples of the securement devices include latches, pins, clamps, straps, and/or the like. Any combination of these securement devices can be utilized to maintain a in the structural framework of the frame. Furthermore, the securement devices shall include, but are not limited to latches, pins, clamps, stationaries, and/or straps. Any combination of these securement devices can be utilized to secure the post to the post installation apparatus. Furthermore, the securement devices may be made from any suitable material including (but not limited to) metals, nylons, plastics, fiberglass, fibers, resin coated high strength woven materials, and/or the like.

Figure 1:
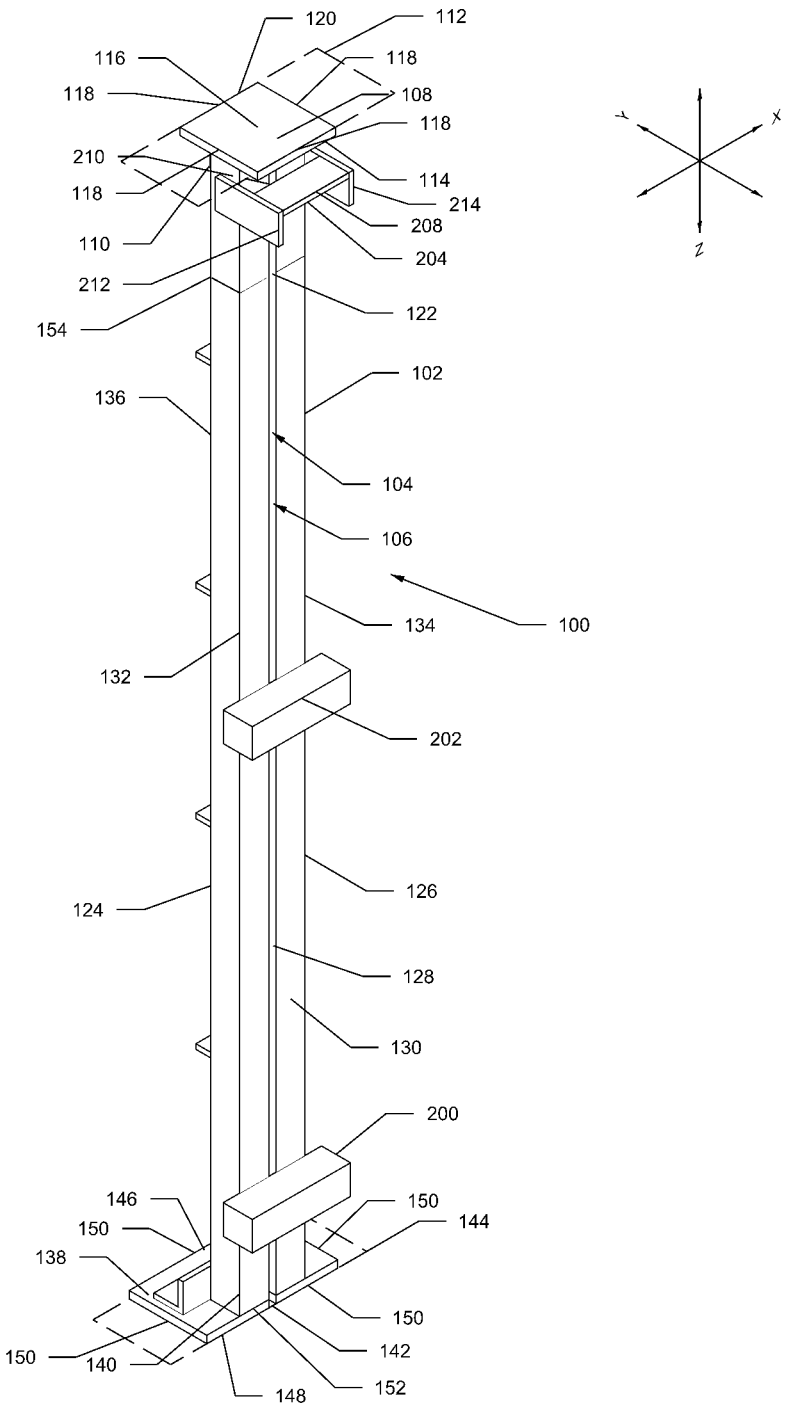
FIG. 1 is a perspective view of one example of a post installation apparatus.

FIG. 1 illustrates one example of a post installation apparatus 100. The post installation apparatus 100 includes a frame 102 that is used to receive a post (not shown in FIG. 1). The post installation apparatus 100 is configured to bear the load applied when installing the post in the ground so that the post installation apparatus 100 reduces the effective length of the post that is subject to buckling forces. More specifically, the portion of the post that is secured to the frame 102 does not experience buckling forces. In this manner, the amount of force that can be applied to the post can be much greater. In some implementations, more than 10 times the force can be applied when installing the post using the post installation apparatus 100 compared to when no post installation apparatus 100 is used.

As shown in FIG. 1, the frame 102 defines an elongated vertical passage 104 configured to receive a post (not explicitly shown in FIG. 1), which in this example is a T-post as explained in further detail below. It should be noted that while the example in FIG. 1 is designed for securing a T-post, alternative embodiments of the post installation apparatus 100 can be designed for any type of post. One would simply need to provide a configuration of the elongated vertical passage 104 that is capable of securing the post to the frame 102.

The elongated vertical passage 104 (and other features discussed in this disclosure) is "elongated" because one dimension of the component is significantly greater than its other dimensions. This dimension in the elongated vertical passage 104 is the "vertical" dimension. Throughout this disclosure, the "vertical" dimension is the dimension of the post installation apparatus 100 (and other features discussed in this disclosure) that extends up and down when the post installation apparatus 104 is oriented so as to install the post in the ground. Thus, regardless of the current orientation of the post installation apparatus 100, the "vertical" dimension of the post installation apparatus 100 is that dimension that extends up and down when the post installation apparatus 100 is oriented to install the post in the ground. This dimension is indicated by the z-axis in FIG. 1. The "horizontal" dimension of the post installation apparatus 100 (and other features discussed in this disclosure) are those dimensions that are orthogonal to the "vertical" dimension. In FIG. 1, these are indicated by the x-axis and the y-axis.

Figure 4:
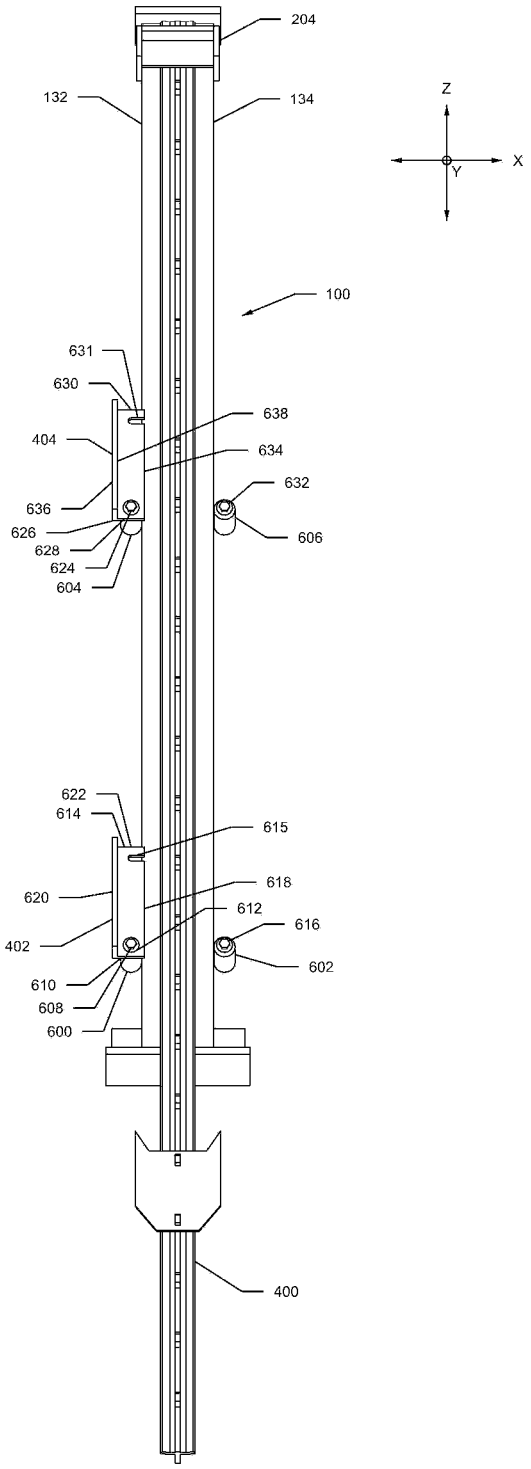
FIG. 4 is a front view of one embodiment of the post installation apparatus shown in FIG. 1 having a T-post placed in an elongated vertical passage and having latches in an open position.

The frame 102 defines the elongated vertical passage 104 such that the post vertically extends through the elongated vertical passage 104 when the elongated vertical passage 104 receives the post (See FIG. 4 for an example). As shown in FIG. 1, the elongated vertical passage 104 defines an elongated vertical opening 106 in the frame 102. The elongated vertical opening 106 is provided so that the post is removable through the elongated vertical opening 106, as explained in further detail below. In this manner, once the desired segment of the post is installed in the ground, the entire post installation apparatus 100 does not have to be lifted to remove the post installation apparatus 100 from the post. Instead, the post is removed from the elongated vertical passage 104 through the elongated vertical opening 106.

In this embodiment, the post installation apparatus 100 includes a top plate 108 that is attached to the top 110 of the frame 102. In general, forces are applied to the top plate 108, when the post installation apparatus 100 is being installed in the ground. The top plate 108 is configured to distribute the load created by the applied forces throughout the frame 102. As shown in FIG. 1, the top plate 108 is oriented along a horizontal plane 112, which extends in the y-direction and the x-direction in this example. Thus, a bottom face 114 of the top plate 108 is attached to the top 110 of the frame 102 while a top face 116 of the top plate 108 faces away from the top 110 of the frame 102. Edges 118 of the top plate 108 thus extend in the x-direction and/or the y-direction in this example. Together, the edges 118 define a perimeter 120 of the top plate 108. The frame 102 also defines a perimeter 122 in the x-direction and the y-direction. Note that the perimeter 120 of the top plate 108 is greater than the perimeter 122 of the frame 102. Thus, the frame 102 is configured such that a perimeter 122 of the frame 102 is horizontally aligned within the perimeter 120 of the top plate 108. This thus allows for the top face 116 to provide a larger area for force distribution and ensures that the load is distributed throughout the frame 102.

In this embodiment, the frame 102 is formed from elongated members 124, 126. The elongated member 124 is attached to the top plate 108 such that the elongated member 124 vertically extends below the top plate 108. Similarly, the elongated member 126 is attached to the top plate 108 such that the elongated member 126 vertically extends below the top plate 108. To form the elongated vertical passage 104, the elongated member 124 and the elongated member 126 are horizontally positioned such that a spacing 128 between the elongated member 124 and the elongated member 126 defines the elongated vertical passage 104 for receiving the post. Thus, the post is received in the elongated vertical passage 104, which is provided by the spacing 128.

The frame 102 thus defines a front vertical side 130, where the term "front" refers to direction from which the post is removed from the frame 102. It should be noted that in alternative embodiments of the post installation apparatus 100, the post may be removed from more than one vertical side and thus the "front" direction may be any of these sides. Thus, the elongated member 124 is referred to as the right elongated member 124 (relative to the front direction F) while the elongated member 126 is also referred to as the left elongated member 126. Given the front direction F, the frame 102 defines the elongated vertical opening 106 on the front vertical side 130. In this example, each of the elongated vertical members 124 have a substantially square and substantially uniform cross sectional area. Accordingly, this embodiment of the frame 102 also defines a right vertical side 132, a left vertical side 134, and a back vertical side 136 (See FIG. 2).

To help stabilize the post installation apparatus 100 when the post installation apparatus 100 is standing on the ground, the post installation apparatus 100 also includes a bottom plate 138 attached to a bottom 140 of the frame 102 wherein the elongated vertical passage 104 extends through the frame 102 and the bottom plate 138. Thus, the bottom plate 138 defines a bottom opening 142. In this manner, a segment of the post can extend below the bottom plate 138 when the post is secured to the elongated vertical passage 104. This segment will then be installed in the ground while the segment of the post above the bottom plate 138 remains above ground, as explained in further detail below.

As shown in FIG. 1, the bottom plate 138 is oriented along a horizontal plane 144, which extends in the y-direction and the x-direction in this example. Thus, a top face 146 of the bottom plate 138 is attached to the bottom 140 of the frame 102 while a bottom face 148 of the bottom plate 138 faces away from the bottom 140 of the frame 102. Edges 150 of the bottom plate 138 thus extend in the x-direction and/or the y-direction in this example. Together, the edges 118 define a perimeter 152 of the bottom plate 138. Note that the perimeter 152 of the bottom plate 138 is greater than the perimeter 122 of the frame 102. Thus, the frame 102 is configured such that a perimeter 122 of the frame 102 is horizontally aligned within the perimeter 152 of the bottom plate 138. However, the frame 102 is configured such that the perimeter 152 of the bottom plate 138 does not extend horizontally past the front vertical side 130 but does extend horizontally past a portion 154 of the perimeter 122 of the frame 102 not at the front vertical side 130. This arrangement allows for the post installation apparatus 100 to have the bottom plate 138 while still allowing the post installation apparatus 100 to secure a T-post, as explained in further detail below.

Figure 2:
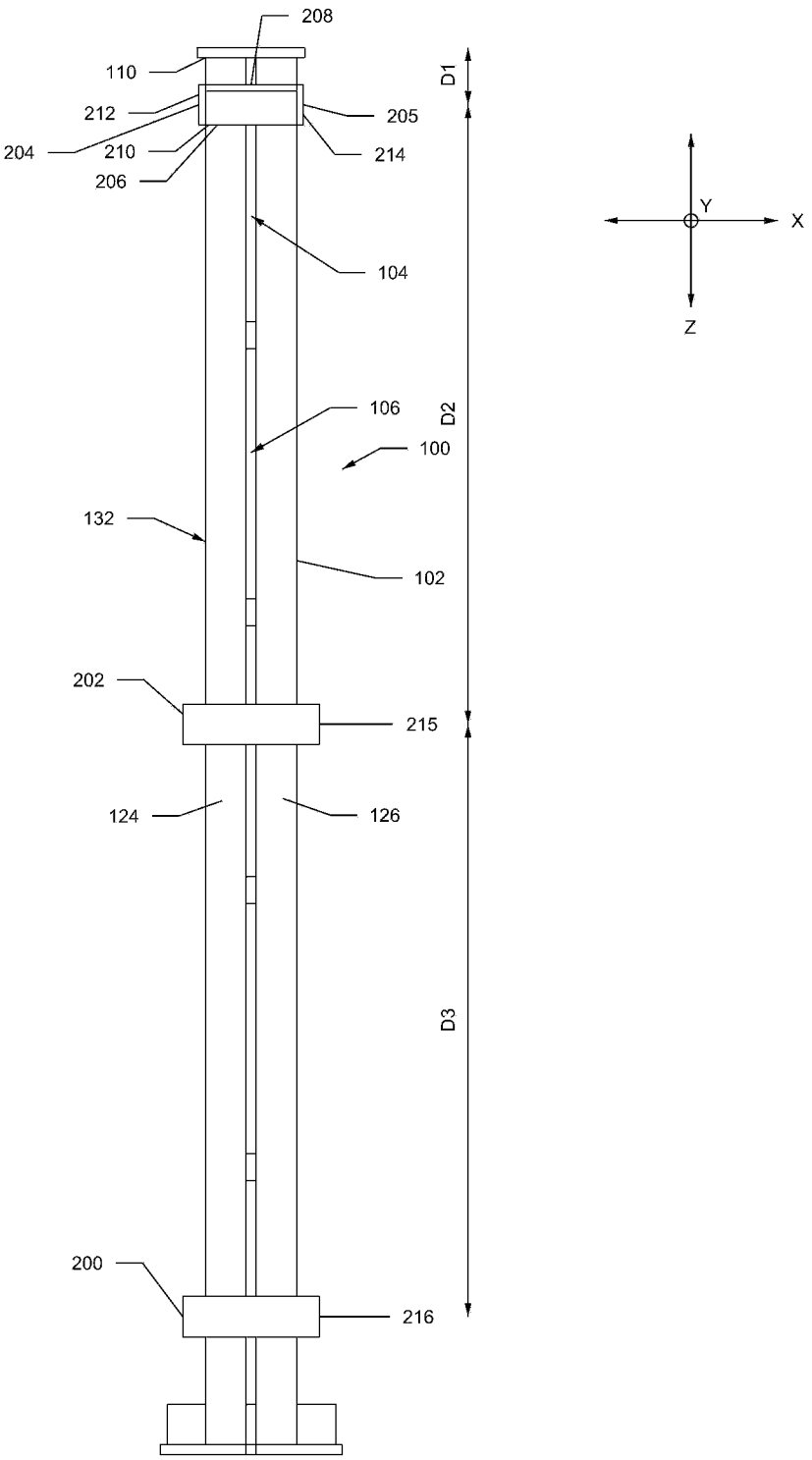
FIG. 2 illustrates a front view of the post installation apparatus described in FIG. 1.

Referring now to FIG. 1 and FIG. 2, FIG. 2 illustrates a front view of the post installation apparatus 100 described in FIG. 1. The post installation apparatus 100 includes one or more securement devices 200, 202, 204. Each of the securement devices 200, 202, 204 is configured to be positioned across the elongated vertical opening 106 so as to secure the post in the elongated vertical passage 104, as shown in FIG. 1 and FIG. 2. However, when there are multiple securement devices (e.g., the securement devices 200, 202, 204) like in the embodiment shown in FIG. 1, the securement devices are attached at different vertical positions.

In this embodiment, the post installation apparatus 100 includes the three securement devices 200, 202, 204. However, in alternative embodiments, the post installation apparatus 100 may include any number of the securement devices 200, 202, 204. Alternative embodiments of the post installation apparatus 100 may include any number of securement devices, like the securement devices 200, 202, 204, greater or equal to one. In this embodiment, each of the securement devices 200, 202, 204 is configured to be positioned across the elongated vertical opening 106, as shown in FIG. 1 and FIG. 2, so as to secure the post in the elongated vertical passage 104.

The securement device 204 is attached to the frame 102 at a vertical position 205, which is a vertical distance D1 from the top 110 of the frame 102 and is vertically higher than of the securement devices 200, 202. In this embodiment, the securement device 204 is fixed in position across the elongated vertical opening 106. In this embodiment, the securement device 204 is formed as an angle iron that has a continuous pair of plates 206, 208 that are connected so as to form an L shape. The plate 206 extends parallel to the z-axis and the x-axis while the plate 208 extends parallel to the x-axis and the y-axis. In this embodiment, the plate 208 extends out from a top edge 210 of the plate 206 to form the L-shape.

In order to attach the securement device 204 to the frame 102, the post installation apparatus 100 includes an arm 212 and an arm 214. The arm 212 is attached to the right vertical side 132 of the frame 102 and the arm 214 is attached to the left vertical side 134 of the frame 102. Each of the arms 212, 214 extend out in the direction F in front of the front vertical side 130 of the frame 102. The securement device 204 is attached between the arms 212, 214 so as to be positioned across the elongated vertical opening 106. The L-shape allows for the securement device 204 to be securely welded to the arms 212, 214.

The securement devices 200, 202 are also configured so as to be positioned across the elongated vertical opening 106. In this manner, the securement devices 200, 202 secure the post in the elongated vertical passage. However, unlike the securement device 204, the securement devices 200, 202 are not fixed. Instead, the securement devices 200, 202 are also positionable so as to not be positioned across the elongated vertical opening 106. In this manner, once the post has been installed in the ground, the securement devices 202, 202 can be positioned so as to no longer be across the elongated vertical opening 106. Thus, the post installation apparatus 100 needs only to be displaced upwards by the distance D1 (since the securement device 204 is fixed) so that the post can be removed from the elongated vertical opening 106. The securement devices 200, 202 may be any type of member capable of being positioned across the elongated vertical opening 106 and then positioned so as to not be positioned across the elongated vertical opening 106. For example, the securement devices 200, 202 may be latches, pins, clasps, fasteners, screws, rivets, sliding bars, and/or the like.

The securement device 202 is attached to the frame 102 at a vertical position 215, where the vertical position 215 is lower than the vertical position 205 of the securement device 204 but is higher than a vertical position 216 of the securement device 200. Additionally, the securement device 202 is attached to the frame 102 at the vertical position 216, which is lower than both vertical positions 205, 215. The different vertical positions 205, 215, 216 are selected so that the post can be secured by the securement devices 200, 202, 204. However, once the post has been installed in the ground, the securement devices 202, 202 can be positioned so as to no longer be across the elongated vertical opening 106. Thus, the post installation apparatus 100 only to be displaced vertically by the distance D1 (since the securement device 204 is fixed to extend horizontally across the elongated vertical opening 106) so that the post can be removed from the post installation apparatus 100. The distance D1 should thus be selected so as to make it easy to remove the post.

Figure 3:
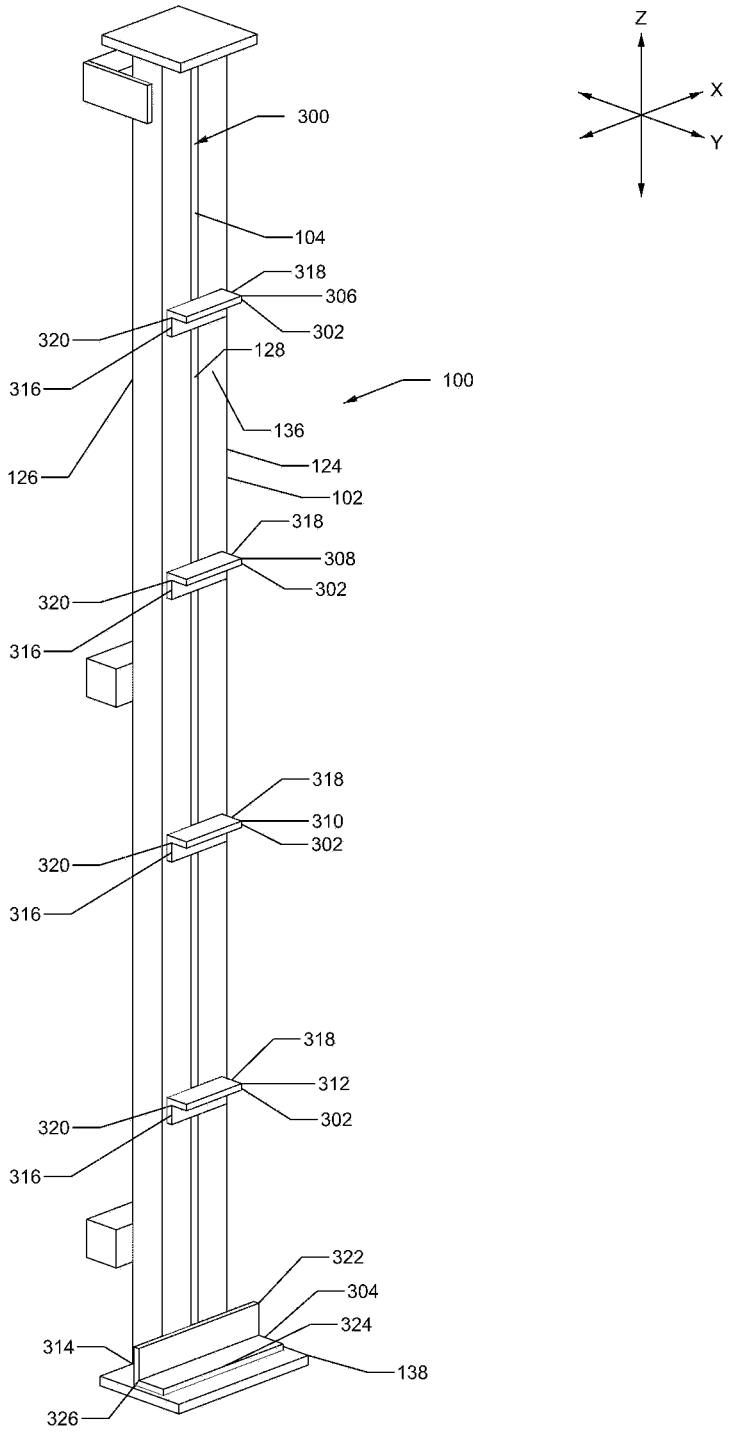
FIG. 3 illustrates a view directed towards a back vertical side of the post installation apparatus shown in FIG. 1.

Referring now to FIG. 1 and FIG. 3, FIG. 3 illustrates a view of the post installation apparatus 100 directed towards the back vertical side 136 of the frame 102. As shown in FIG. 3, the elongated member 124 and the elongated member 126 are aligned with one another such that the spacing 128 defines an elongated vertical opening 300 oppositely disposed from the elongated vertical opening 106. Since the elongated member 124 and the elongated member 126 are separate elongated members 124, 126, a force generated on the top plate 108 while the post installation apparatus 100 rest vertically on the ground may tend to try to pull the elongated members 124, 126 apart. In order to reinforce the structural integrity of the post installation apparatus 100, the post installation apparatus 100 may include one or more load bearing members 302 attached across the elongated vertical opening 300 on the back vertical side 136 of the post installation apparatus 100.

In this embodiment, the post installation apparatus 100 includes a plurality of the load bearing member 302. More specifically, this embodiment of the post installation apparatus 100 includes four of the load bearing members 302. In addition, the post installation apparatus 100 includes a load bearing member 304 that is attached across the elongated vertical opening 300 and is attached to the bottom plate 138 of the post installation apparatus 100. Each of the load bearing members 302 are attached at different vertical positions 306, 308, 310, 312. The load bearing member 304 is attached at the vertical position 314, which is the lowest vertical position 314 and is thus below the vertical positions 306, 308, 310, 312. In this embodiment, the vertical positions 306, 308, 310, 312 are ordered from highest to lowest. The vertical positions 306, 308, 310, 312, 314 are evenly distributed vertically along the frame 102.

With regards to the load bearing members 302, each of the load bearing members 302 is formed as an angle iron that has a continuous pair of plates 316, 318 that are connected so as to form an L shape. The plate 316 extends parallel to the z-axis and the x-axis while the plate 318 extends parallel to the x-axis and the y-axis. In each of the load bearing members 302, the plate 318 extends out from a top edge 320 of the plate 316 to form the L-shape. Furthermore, the plate 316 is attached to the frame 102 so as to extend across the elongated vertical opening 300. In this manner, each of the load bearing members 302 resist any forces trying to increase the spacing 128 to help maintain the structural integrity of the frame 102.

With regards to the load bearing member 304, the load bearing member 304 is formed as an angle iron that has a continuous pair of plates 322, 324 that are connected so as to form an L shape. The plate 322 extends parallel to the z-axis and the x-axis while the plate 324 extends parallel to the x-axis and the y-axis. In this embodiment, the plate 324 extends out from a bottom edge 326 of the plate 322 to form the L-shape. The plate 324 rest on and is attached to the bottom plate 138, so that the plate 324 helps distribute load forces on the frame 102 throughout the bottom plate 138. Furthermore, the plate 322 is attached to the frame 102 so as to extend across the elongated vertical opening 300. In this manner, the load bearing member 304 also resist any forces trying to increase the spacing 128 to help maintain the structural integrity of the frame 102.

Referring now to FIG. 4, FIG. 4 illustrates one embodiment of the post installation apparatus 100 wherein a T-post 400 has been placed in the elongated vertical passage 104. In this embodiment of the post installation apparatus 100, the post installation apparatus 100 includes latches 402, 404, which are embodiments of the securement devices 200, 204 described above with respect to FIG. 1 and FIG. 2.

Each of the latches 402, 404 is movably attached to the frame so as to be configured to swing across the elongated vertical opening 106 in the closed position and so as to be configured to swing so as to not be across the elongated vertical opening 106 in the open position. In FIG. 4, the latches 402, 404 are shown in the open position, which allows for the T-post 400 to be placed in the elongated vertical passage 104.

Figure 5:
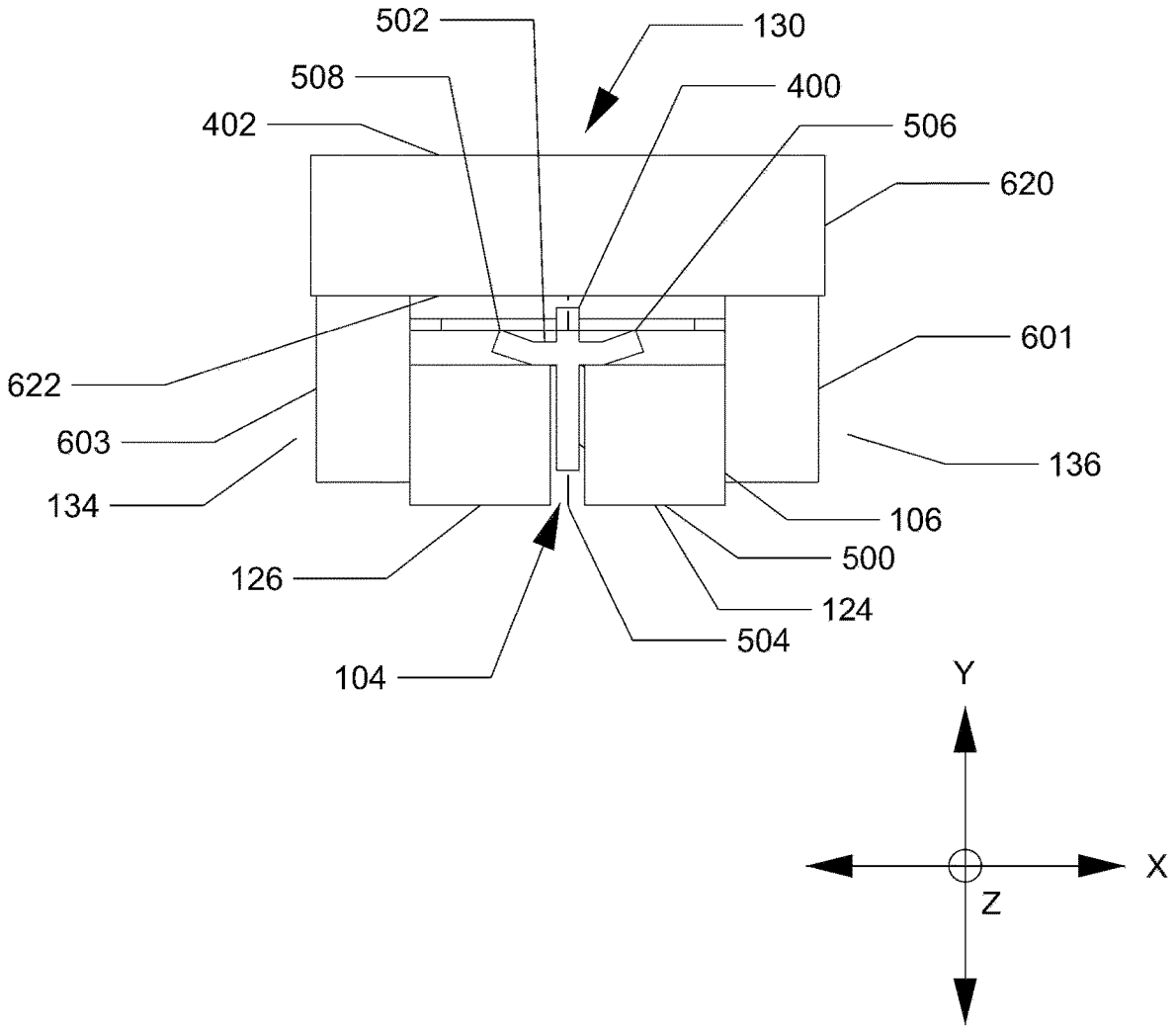
FIG. 5 is a cross sectional view of the post installation apparatus with the T-post shown in FIG. 4.

Referring now to FIG. 5, FIG. 5 is a cross sectional view along the x and y-axis of the T-post 400 when the T-post 400 has been placed in the elongated vertical passage 104. Furthermore, the latch 402 is shown in the closed position, which secures the T-post 400 in the post installation apparatus 100. As shown in FIG. 5, the T-post 400 includes a main post branch 500 and a transverse post branch 502. The main post branch 500 intersects the transverse post branch 502 at a midline 504 so that the transverse post branch 502 provides transverse arms 506, 508 that extend in transversely from the midline 504. As shown in FIG. 5, when the T-post 400 is received in the elongated vertical passage 104, the main post branch 500 is inserted into the elongated vertical passage 104. Furthermore, the transverse post branch 502 rests on the front vertical side 130 of the elongated member 124 and the elongated member 126.

Figure 6:
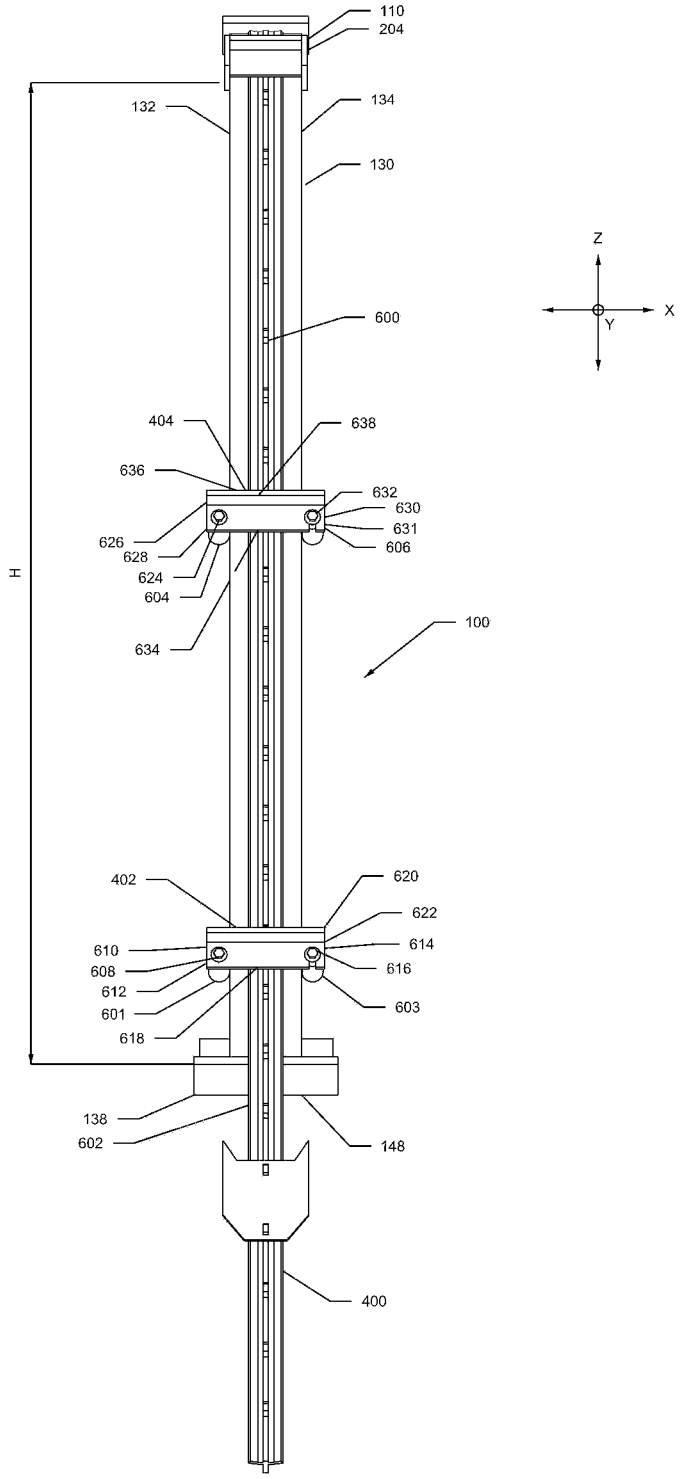
FIG. 6 is a front view of one embodiment of the post installation apparatus shown in FIG. 4 having the T-post placed in the elongated vertical passage and having latches in a closed position.

FIG. 6 is a front view of the post installation apparatus 100 with the T-post 400 in the elongated vertical passage 104 (See FIG. 1 and FIG. 2) and with the latches 402, 404 swung across the elongated vertical opening 106 (See FIG. 1 and FIG. 2) in the closed position. As shown in FIG. 4, the post installation apparatus 100 has a height H from the top 110 of the frame 102 to the bottom face 148 of the bottom plate 138. A post segment 600 of the T-post 400 is provided in the post installation apparatus 100 while a post segment 602 of the T-post 400 extends out of the post installation apparatus 100. In this embodiment, the post segment 600 is much longer than the post segment 602. Furthermore, the post segment 600 is not subject to buckling (or is subject to very little buckling) since the post segment 600 is secured in the post installation apparatus 100. The post segment 602 is subject to buckling but is generally much shorter than the post segment 600. The post segment 602 is the section of the T-post 400 that will be installed in the ground, as explained in further detail below. In one example, the height H (which is also the length of the post segment 600) is approximately 52 inches while the post segment 602 is approximately 20 inches in length.

Referring now to FIG. 4, FIG. 5, and FIG. 6, this embodiment of the latches 402, 404 are hingedly attached to the frame 102. For each of the latches 402, 404, the post installation apparatus 100 includes a pair of round bars (600, 602), (604, 606) are provided. The round bars 600, 604 are attached to the right vertical side 132 of the frame 102 while the round bars 602, 606 are attached to the left vertical side 134 of the frame 102.

With regards to the latch 402, a bolt 608 is inserted through an end 610 of the latch 402 and through the round bar 600. In this manner, the bolt 608 and the round bar 600 form a hinge 612 where the end 610 of the latch 402 is swung about the hinge 612. The end 614 opposing the end 612 has a groove 614. Another bolt 616 is partially inserted through the round bar 602. In this manner, the latch 612 is configured to be swung so that the groove 614 receives the bolt 616 to secure the latch 402 in the closed position. Screws (not explicitly labeled with an element number) are used to lock the bolts in place to keep them from backing out.

In this embodiment, the latch 402 is formed by an angle iron formed as a continuous pair of plates 618, 620 that are connected so as to form an L shape. The plate 618 extends parallel to the z-axis and the x-axis while the plate 620 extends parallel to the x-axis and the y-axis. The plate 618 is attached by the bolt 608 to form the hinge 612 at the end 610 and further forms the groove 610. Furthermore, in this embodiment, the plate 620 extends out from a top edge 622 of the plate 618 to form the L-shape. The plate 620 can be grabbed by a user's hand so that the latch 402 can be opened and closed.

With regards to the latch 404, a bolt 624 is inserted through an end 626 of the latch 404 and through the round bar 600. In this manner, the bolt 624 and the round bar 600 form a hinge 628 where the end 626 of the latch 404 is swung about the hinge 628. The end 630 opposing the end 628 has a groove 630. Another bolt 632 is partially inserted through the round bar 602. In this manner, the latch 628 is configured to be swung so that the groove 630 receives the bolt 632 to secure the latch 404 in the closed position.

In this embodiment, the latch 404 is formed as an angle iron that has a continuous pair of plates 634, 636 that are connected so as to form an L shape. The plate 634 extends parallel to the z-axis and the x-axis while the plate 636 extends parallel to the x-axis and the y-axis. The plate 634 is attached by the bolt 624 to form the hinge 628 at the end 626 and further forms the groove 626. Furthermore, in this embodiment, the plate 636 extends out from a top edge 638 of the plate 634 to form the L-shape. The plate 636 can be grabbed by a user's hand so that the latch 404 can be opened and closed.

Figure 7:
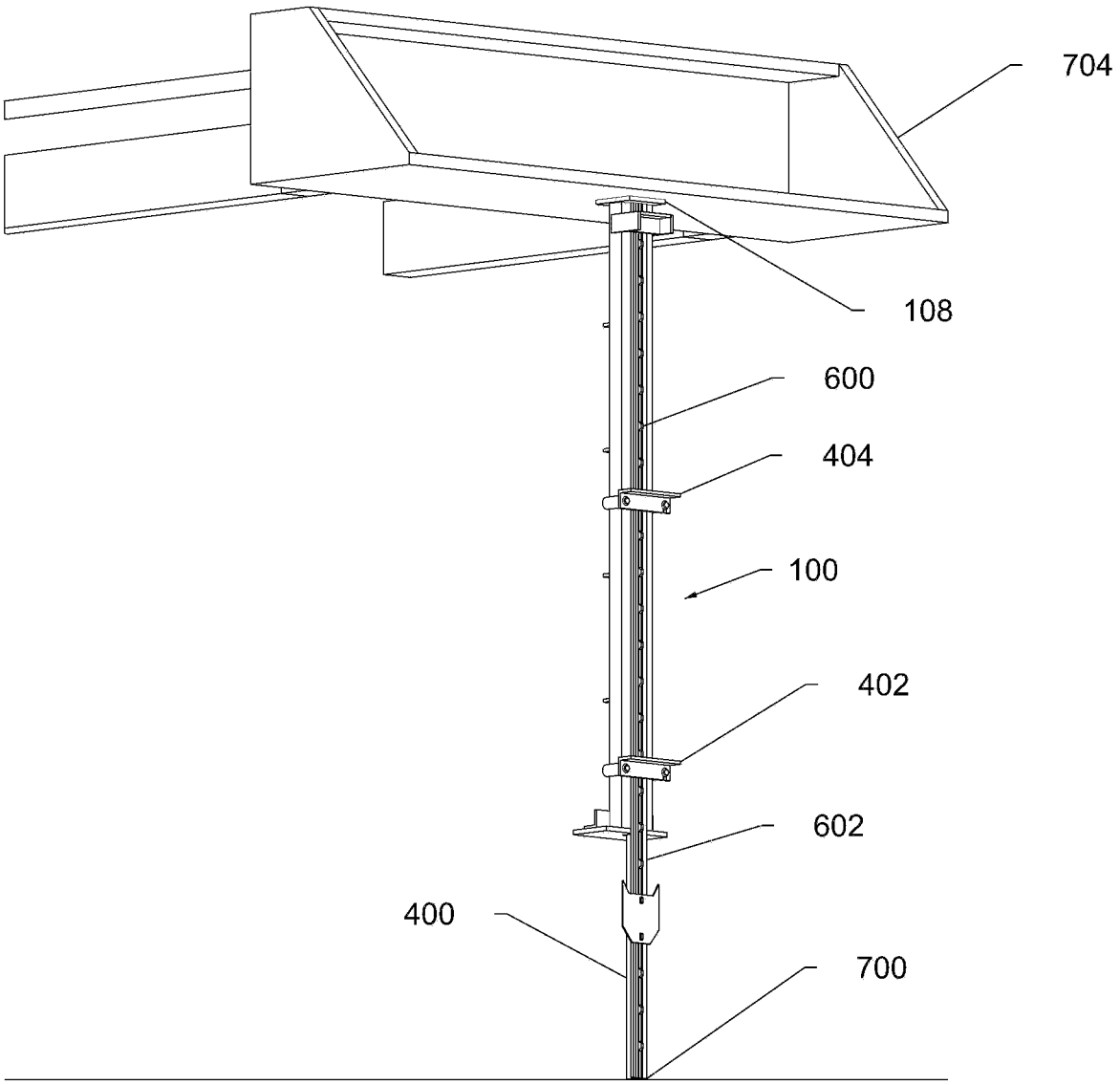
FIG. 7 illustrates the post installation apparatus shown in FIGS. 4, 5, 6 at a desired location for installing the T-post.

FIG. 7 illustrates the post installation apparatus 100 shown in FIGS. 4, 5, 6 with the T-post 400 secured by the latches 402, 404 in the post installation apparatus 100. The post installation apparatus 100 is shown at a desired location 700 for installing the T-post 400. In this embodiment, a tractor 702 is being used to install the T-post 400 in the ground at the desired location 700. A bucket 704 of the tractor 702 is being used to provide the force against the top plate 108 that installs the T-post 400. It should be noted that however that any convenient mechanism may be used to install the T-post 400 using the post installation apparatus 100. Once the T-post 400 is secured in the post installation apparatus 100, only the post segment 602 is subject to buckling while the post segment 600 is not subject to buckling. In this manner, the post installation apparatus 100 allows for a much higher force to be applied to install the T-post 400.

Figure 8:
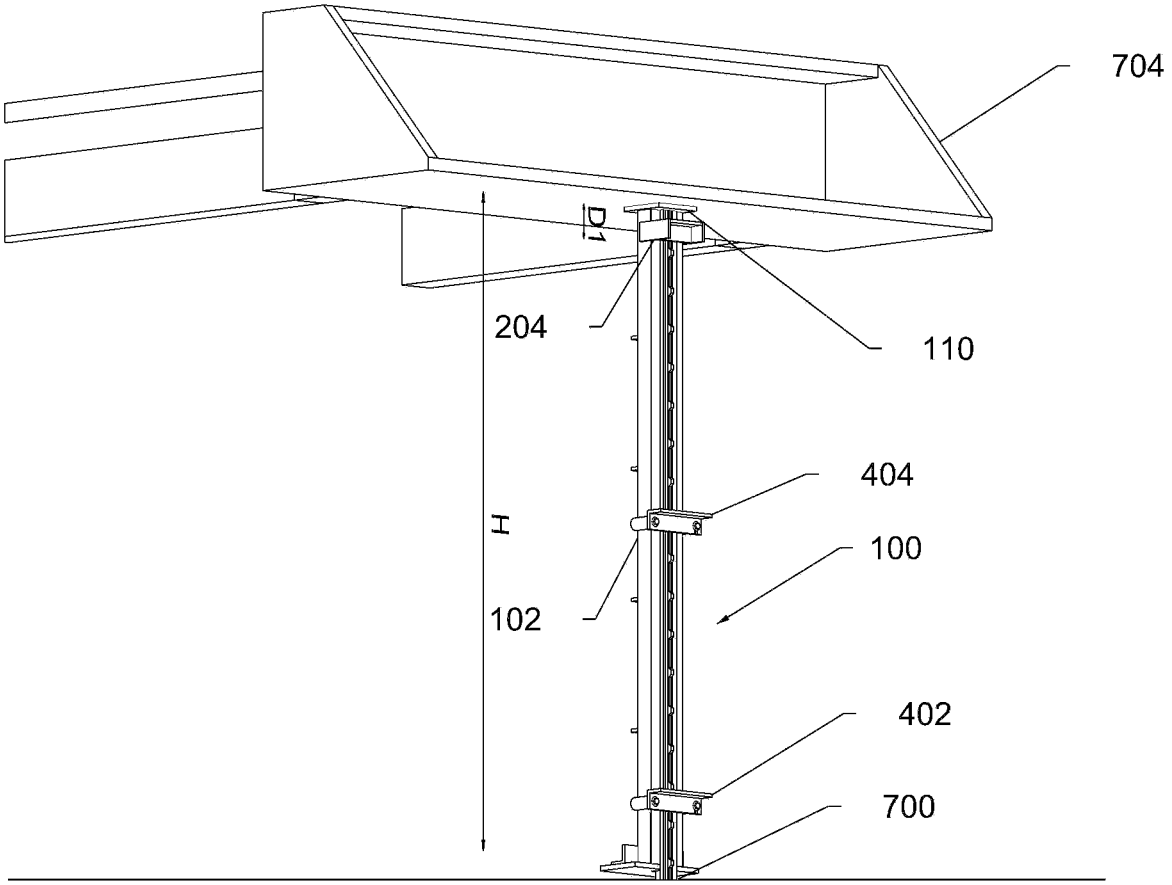
FIG. 8 illustrates the post installation apparatus shown in FIGS. 4, 5, 6, 7 with the T-post installed at the desired location by the bucket of a tractor.

FIG. 8 illustrates the post installation apparatus 100 shown in FIGS. 4, 5, 6, 7 with the T-post 400 installed at the desired location 700 by the bucket 704 of the tractor 702. Once the T-post 400 is installed, the latches 402, 404 can then be opened. The main post branch 500 (See FIG. 5) of the T-post 400 can be removed through the elongated vertical opening 106 (See FIG. 5) from the elongated vertical passage 104. The post installation apparatus 100 then only needs to be moved up by the vertical distance D1, which is also the vertical distance D1 from the top 110 of the frame 102 to the securement device 204, which is fixed. In this manner, the post installation apparatus 100 can be removed from the T-post 400 after installation without having to lift the post installation apparatus 100 by the distance H, which is also the height of the post installation apparatus 100.

Figure 9:
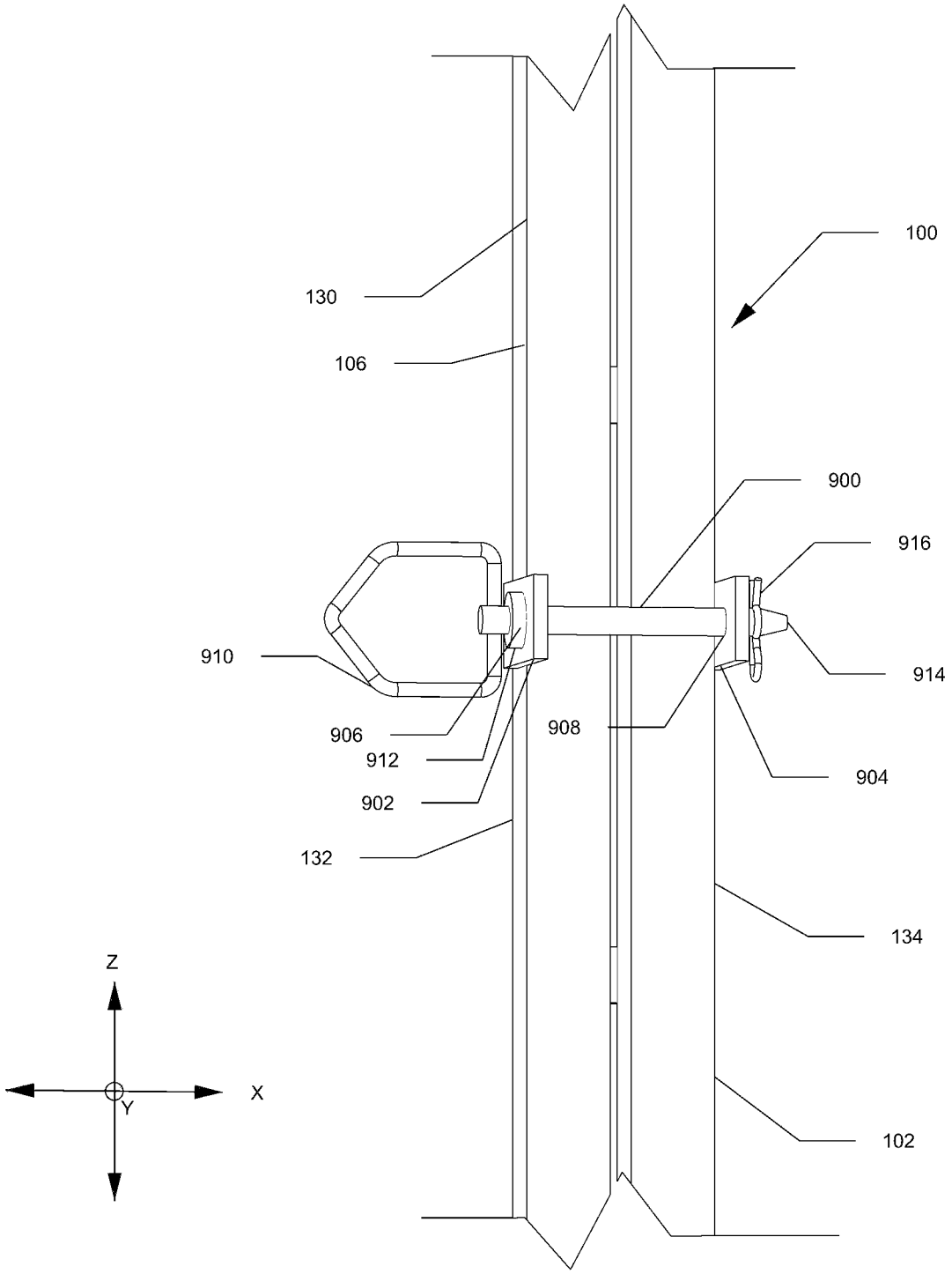
FIG. 9 illustrates an exemplary pin that may be used to securement device.

FIG. 9 illustrates an exemplary pin 900 that may be used to secure the T-post 400 (See FIG. 4, FIG. 5, FIG. 6) in the post installation apparatus 100. The exemplary removable pin 900 is an example of a securement device and one or more of the securement devices 124, 126 shown in FIG. 1 and FIG. 2 may each be provided as the pin 900 shown in FIG. 9. The removable pin 900 is removeably attachable to the frame 102 such that the removable pin 900 extends across the elongated vertical opening 106.

In this embodiment, the post installation apparatus 100 includes an arm 902 and an arm 904. The arm 902 is attached to the right vertical side 132 of the frame 102 and the arm 904 is attached to the left vertical side 134 of the frame 102. Each of the arms 902, 904 extend out in the direction F in front of the front vertical side 130 of the frame 102. The arms 902, 904 define aligned apertures 906, 908 configured to receive the removeably pin 900. Once the pin 900 is received through the apertures 906, 908, the removable pin 900 is positioned across the elongated vertical opening 106. In this embodiment, a handle 910 is provided at one end 912 of the removable pin 900, which allows a user to easily grab the removable pin 900. Furthermore, an oppositely disposed end 914 is configured to receive a retainment clip 916. When the retainment clip 916 is received by the oppositely disposed end 914, the retainment clip 916 ensures that the end 914 cannot slip out of the aperture 908 thereby helping secure the removable pin 900 across the elongated vertical opening 106.

Figure 10:
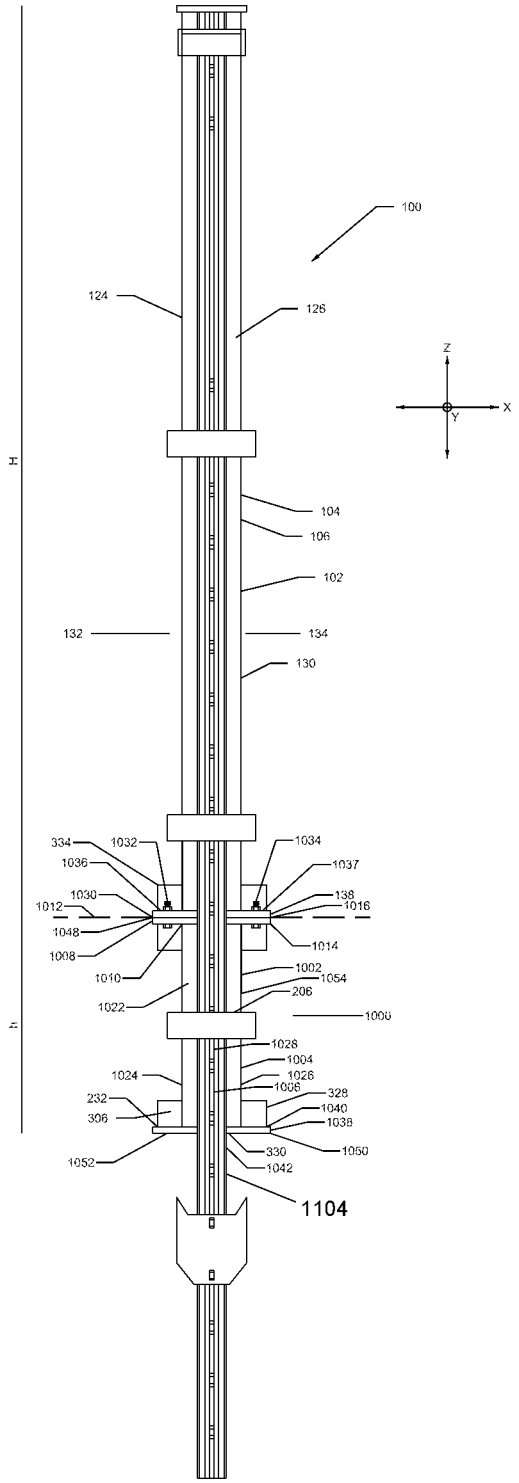
FIG. 10 illustrates an embodiment of the post installation apparatus described in FIG. 1, FIG. 2, and FIG. 3 with an attached frame extension.

FIG. 10 illustrates an embodiment of the post installation apparatus 100 described in FIG. 1, FIG. 2, and FIG. 3 with a frame extension 1000 attached to the bottom plate 138 so as to effectively extend the frame 102 and the elongated vertical passage 104 of the post installation apparatus 100. The frame extension 1000 allows for the post installation apparatus 1000 to be used to install different sized T-post (See FIG. 11), as explained in further detail below. Note that while post installation apparatus 100 is shown in FIG. 10 with the single frame extension 1000, the post installation apparatus 100 may have one or more additional frame extensions (not shown) attached to each other and/or the frame extension 1000 so that the post installation apparatus 100 can be used to install various sizes of T-post. The frame extension 1000 may be provided at any desired height h depending on the desired application. In one example, the height h of the frame extension 1000 is approximately twelve inches while the height H of the post installation apparatus 100 without the frame extension 1000 is approximately 52 inches. Accordingly, in this example, the height H+h of the post installation apparatus 100 with the frame extension 1000 is approximately 64 inches.

The frame segment 1002 defines an elongated vertical passage 1004 configured to receive a post (not explicitly shown in FIG. 10), which in this example is a T-post as explained in further detail below. It should be noted that while the example in FIG. 10 is designed for securing a T-post alternative embodiments of the frame extension 1000 can be designed for any type of post. One would simply need to provide a configuration of the elongated vertical passage 1004 that is capable of securing the post to the frame segment 1002.

The frame segment 1002 defines an elongated vertical passage 1004 configured to receive a post (not explicitly shown in FIG. 10), which in this example is a T-post as explained in further detail below. It should be noted that while the example in FIG. 10 is designed for securing a T-post alternative embodiments of the frame extension 1000 can be designed for any type of post. One would simply need to provide a configuration of the elongated vertical passage 1004 that is capable of securing the post to the frame segment 1002.

Figure 11:
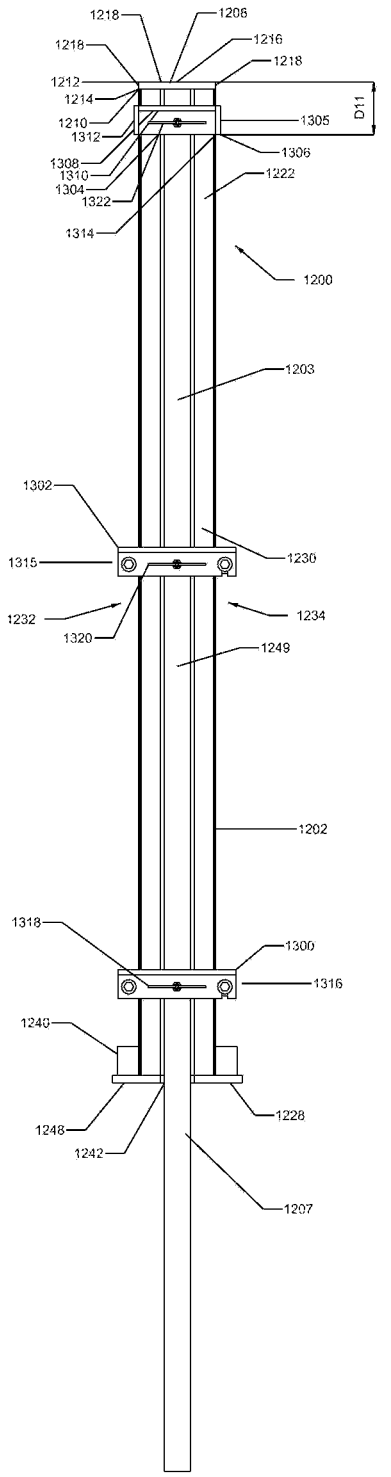
FIG. 11 illustrates the post installation apparatus shown in FIG. 10 with a T-post.

The frame segment 1002 defines the elongated vertical passage 1004 such that the post vertically extends through the elongated vertical passage 1004 when the elongated vertical passage 1004 receives the post (See FIG. 11 for an example). As shown in FIG. 10, the elongated vertical passage 1004 defines an elongated vertical opening 1006 in the frame segment 1002. The elongated vertical opening 1006 is provided so that the post is removable through the elongated vertical opening 1006, as explained in further detail below. In this manner, the segment of the post in the frame extension 1000 is removed from the elongated vertical passage 1004 through the elongated vertical opening 1006.

The frame extension 1000 is removeably couplable to the frame 102 such that the elongated vertical passage 1004 integrates with the elongated vertical passage 104 so as to extend the height H of the elongated vertical passage 104 to the height H+h when the frame extension 1000 is coupled to the frame 102. In this embodiment, the frame extension 1000 includes a top plate 1008 that is attached to the top 1010 of the frame segment 1002. As shown in FIG. 10, the top plate 1008 is oriented along a horizontal plane 1012, which extends in the y-direction and the x-direction in this example. Thus, a bottom face 1014 of the top plate 1008 is attached to the top 1010 of the frame segment 1002 while a top face 1016 of the top plate 1008 faces away from the top 1010 of the frame segment 1002. Edges 1018 of the top plate 1008 thus extend in the x-direction and/or the y-direction in this example. Together, the edges 1018 define a perimeter 1020 of the top plate 1008. The frame segment 1002 also defines a perimeter 1022 in the x-direction and the y-direction. Note that the perimeter 1020 of the top plate 1008 is greater than the perimeter 1022 of the frame segment 1002. Thus, the frame segment 1002 is configured such that a perimeter 1022 of the frame segment 1002 is horizontally aligned within the perimeter 1020 of the top plate 1008. This thus allows for the top face 1016 to provide a larger area for force distribution and ensures that the load is distributed throughout the frame segment 1002.

In this embodiment, the frame segment 1002 is formed from elongated member segments 1024, 1026. The elongated member segment 1024 is attached to the top plate 1008 such that the elongated member segment 1024 vertically extends below the top plate 1008. Similarly, the elongated member segment 1026 is attached to the top plate 1008 such that the elongated member segment 1026 vertically extends below the top plate 1008. To form the elongated vertical passage 1004, the elongated member segment 1024 and the elongated member segment 1026 are horizontally positioned such that a spacing 1028 between the elongated member segment 1024 and the elongated member segment 1026 defines the elongated vertical passage 1004 for receiving the post. Thus, the post is received in the elongated vertical passage 1004, which is provided by the spacing 1028.

Note that, in this embodiment, the perimeter 1020 of the top plate 1008 is approximately equal to the perimeter 152 of the bottom plate 138 attached to the bottom 140 of the frame 102. In order to removeably attach the frame segment 1000, a top face 1030 of the top plate 1008 is placed on and aligned with the bottom face 148 of the bottom plate 138. Any convenient attachment method may be used to attach the top plate 1008 and the bottom plate 138. In this embodiment, bolts 1032, 1034 are inserted through the top plate 1008 and the bottom plate 138. Washers 1036, 1037 are then screwed on the bolts 1032, 1034 to secure the frame extension 1000 to the bottom plate 138. These and other attachment mechanisms would be apparent to one of ordinary skill in the art in light of this disclosure.

To help stabilize the post installation apparatus 100 when the post installation apparatus 1000 is standing on the ground, the frame extension 1000 also includes a bottom plate 1038 attached to a bottom 1040 of the frame segment 1002 wherein the elongated vertical passage 1004 extends through the frame segment 1002 and the bottom plate 1038. Thus, the bottom plate 1038 defines a bottom opening 1042. In this manner, a segment of the post can extend below the bottom plate 1038 when the post is secured in the elongated vertical passage 1004. This segment will then be installed in the ground while the segment of the post above the bottom plate 1038 remains above ground, as explained in further detail below.

As shown in FIG. 10, the bottom plate 1038 is oriented along a horizontal plane 1044, which extends in the y-direction and the x-direction in this example. Thus, a top face 1046 of the bottom plate 1038 is attached to the bottom 1040 of the frame segment 1002 while a bottom face 1048 of the bottom plate 1038 faces away from the bottom 1040 of the frame segment 1002. Edges 1050 of the bottom plate 1038 thus extend in the x-direction and/or the y-direction in this example. Together, the edges 1018 define a perimeter 1052 of the bottom plate 1038. Note that the perimeter 1052 of the bottom plate 1038 is greater than the perimeter 1022 of the frame segment 1002. Thus, the frame segment 1002 is configured such that a perimeter 1022 of the frame segment 1002 is horizontally aligned within the perimeter 1052 of the bottom plate 1038. However, the frame segment 1002 is configured such that the perimeter 1052 of the bottom plate 1038 does not extend horizontally past the front vertical side 130 but does extend horizontally past a portion 1054 of the perimeter 1022 of the frame segment 1002 not at the front vertical side 130. This arrangement allows for the post installation apparatus 1000 to have the bottom plate 1038 while still allowing the post installation apparatus 1000 to secure a T-post, as explained in further detail below.

The elongated vertical passage 1004 and the elongated vertical opening 1006 extend from the top face 1030 of the top plate 1030, through the top plate 1030, the frame segment 1002, through the bottom plate 1038, to the bottom face 1048 of the bottom plate 1038. In this manner, the elongated vertical passage 1004 is extended by the elongated vertical passage 1004 and the elongated vertical opening 106 is extended by the elongated vertical opening 1006 when the frame extension 1000 is removeably attached to the bottom plate 138 that is connected to the frame 102.

The frame extension 100 further includes a securement device 206, which is like the securement devices 200, 202. The securement device 206, is configured so as to be positioned across the elongated vertical opening 1006, as shown in FIG. 10. However, the securement device 206 is also positionable so as to not be positioned across the elongated vertical opening 1006. In this manner, once the post has been installed in the ground, the securement device 206 can be positioned so as to no longer be across the elongated vertical opening 1006 in order to remove the post. To provide some specific examples, the securement device 206 may be provided in the same manner as the latches 402, 404 described above or the removable pin 900 described above.

In addition, the frame extension 100 includes a load bearing member 306 that is attached across the elongated vertical opening 1006 and is attached to the bottom plate 1038 of the frame extension 100. The load bearing member 306 is formed as an angle iron that has a continuous pair of plates 328, 330 that are connected so as to form an L shape. The plate 328 extends parallel to the z-axis and the x-axis while the plate 330 extends parallel to the x-axis and the y-axis. In this embodiment, the plate 330 extends out from a bottom edge 332 of the plate 328 to form the L-shape. The plate 330 rest on and is attached to the bottom plate 1038, so that the plate 330 helps distribute load forces on the frame segment 1002 throughout the bottom plate 1038. Furthermore, the plate 328 is attached to the frame segment 1002 so as to extend across the elongated vertical opening 300. In this manner, the load bearing member 306 also resist any forces trying to increase the spacing 1028 to help maintain the structural integrity of the frame segment 1002.

FIG. 11 illustrates the post installation apparatus 100 shown in FIG. 10 with a T-post 1100. As shown in FIG. 11, the post installation apparatus 100 has a height H+h from the top 110 of the frame 102 to the bottom face 1048 of the bottom plate 1038. A post segment 1102 of the T-post 1100 is provided in the post installation apparatus 100 while a post segment 1104 of the T-post 1100 extends out of the post installation apparatus 100. In this embodiment, the post segment 1102 is much longer than the post segment 1104. Furthermore, the post segment 1102 is not subject to buckling (or is subject to very little buckling) since the post segment 1102 is secured in the post installation apparatus 100. The post segment 1104 is subject to buckling but is generally much shorter than the post segment 1102. The post segment 1104 is the section of the T-post 1100 that will be installed in the ground, as explained in further detail below. In one example, the height H+h (which is also the length of the post segment 1102) is approximately 64 inches while the post segment 1104 is approximately 20 inches in length.

With regards to the post segment 1104, the post segment 1102 has a post segment 1106 that portion of the post installation apparatus 100 that is not the frame extension 1000, while a post segment 1108 is provided in the frame extension 1000. The post segment 1106 has a length equal to the height H and the post segment 1108 has a length equal to the height h. In one example, H is equal to 52 inches while h is equal to 12 inches. Accordingly, only the post segment 1104 having the length of 20 inches is subject to buckling while the entire post segment 1102 is not subject to buckling. These 20 inches are the same as the 20 inches subject to buckling in the T-post 400, as described above with respect to FIG. 6. Thus, the frame extension 1000 (or multiple frame extensions, like the frame extension 1000) can be provided to maintain the length of the T-post (400, 1100) subject to buckling the same regardless of the length of the T-post (400, 1100).

Figure 12:
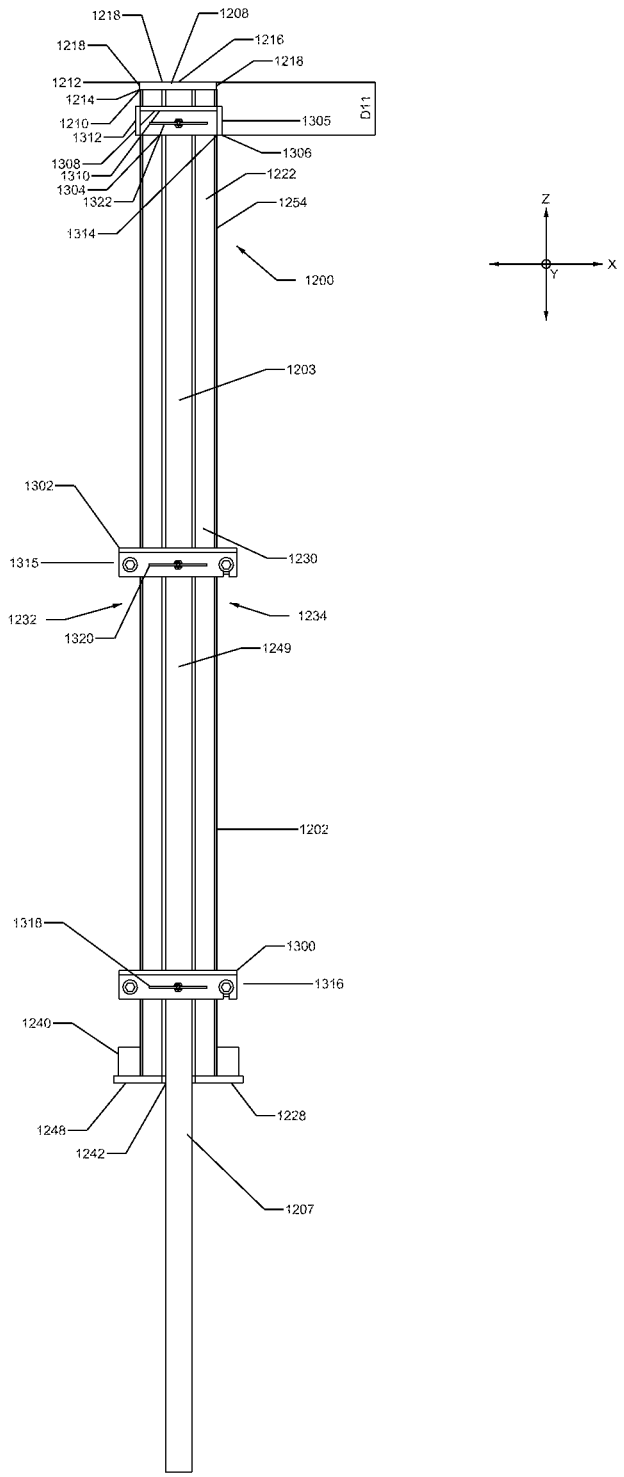
FIG. 12 is a front view of another exemplary embodiment of a post installation apparatus that is holding a round post.
Figure 13:
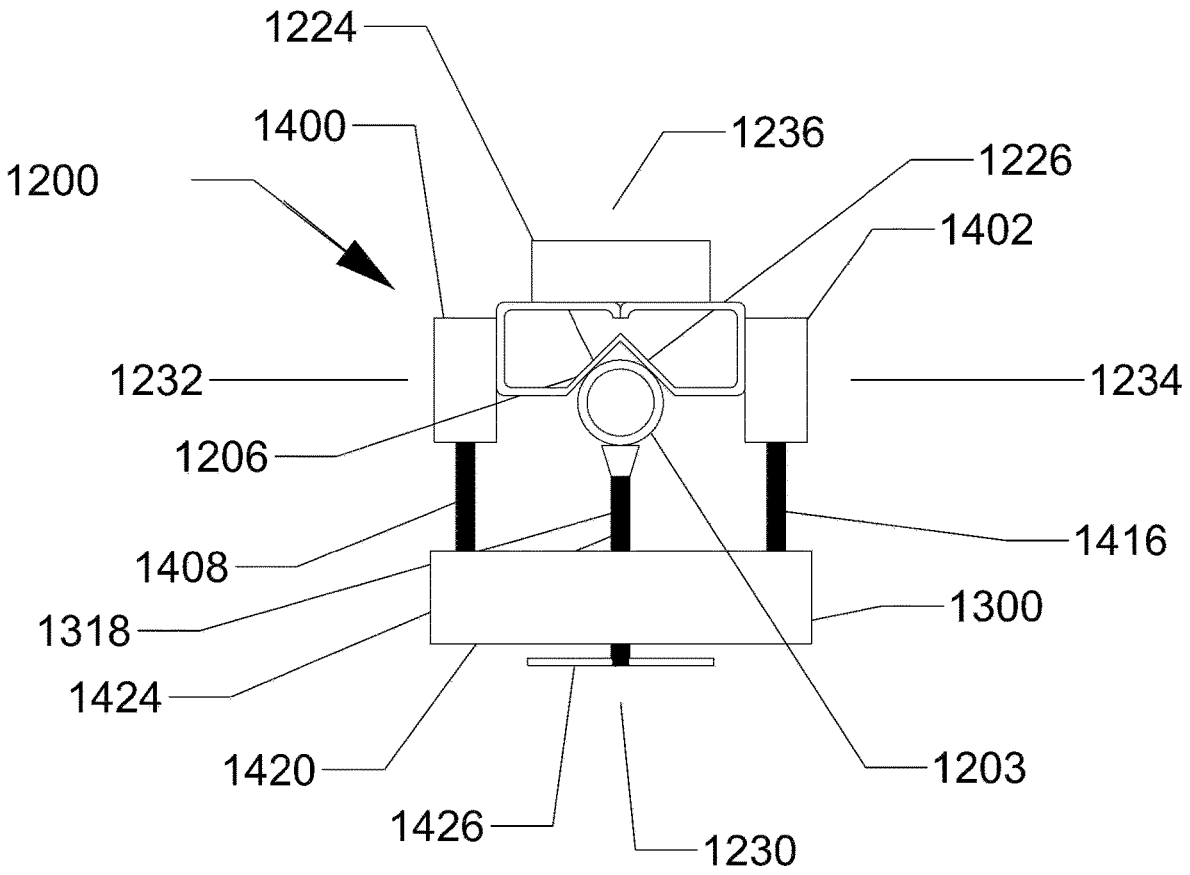
FIG. 13 is a cross sectional view of the post installation apparatus shown in FIG. 12.

FIG. 12 and FIG. 13 illustrates another example of a post installation apparatus 1200. FIG. 12 is a front view of the post installation apparatus 1200 while FIG. 13 is a cross sectional view of the post installation apparatus 1200. The post installation apparatus 1200 includes a frame 1202 that is used to receive a round post 1203. The post installation apparatus 1200 is configured to bear the load applied when installing the post in the ground so that the post installation apparatus 1200 reduces the effective length of the post that is subject to buckling forces. More specifically, the portion of the post that is secured to the frame 1202 does not experience buckling forces. In this manner, the amount of force that can be applied to the post can be much greater. In some implementations, more than 10 times the force can be applied when installing the post using the post installation apparatus 1200 compared to when no post installation apparatus 1200 is used.

As shown in FIG. 12 and FIG. 13, the frame 1202 defines an elongated vertical passage 1204 configured to receive the round post 1200, which in this example is the round post 1203 as explained in further detail below. It should be noted that while the example in FIG. 12 and FIG. 13 is designed for securing the round post 1203 alternative embodiments of the post installation apparatus 1200 can be designed for any type of post. One would simply need to provide a configuration of the elongated vertical passage 1204 that is capable of securing the post to the frame 1202.

The frame 1202 defines the elongated vertical passage 1204 such that the post vertically extends through the elongated vertical passage 1204 when the elongated vertical passage 1204 receives the round post 1203. As shown in FIG. 13, the elongated vertical passage 1204 defines an elongated vertical opening 1206 in the frame 1202. The elongated vertical opening 1206 is provided so that the post is removable through the elongated vertical opening 1206, as explained in further detail below. In this manner, once the desired segment of the post is installed in the ground, the entire post installation apparatus 1200 does not have to be lifted to remove the post installation apparatus 1200 from the post. Instead, the post is removed from the elongated vertical passage 1204 through the elongated vertical opening 1206.

Referring again to FIG. 12 and FIG. 13, the post installation apparatus 1200 includes a top plate 1208 that is attached to the top 1210 of the frame 1202. In general, forces are applied to the top plate 1208, when the post installation apparatus 1200 is being installed in the ground. The top plate 1208 is configured to distribute the load created by the applied forces throughout the frame 1202. As shown in FIG. 12 and FIG. 13, the top plate 1208 is oriented along a horizontal plane 1212, which extends in the y-direction and the x-direction in this example. Thus, a bottom face 1214 of the top plate 1208 is attached to the top 1210 of the frame 1202 while a top face 1216 of the top plate 1208 faces away from the top 1210 of the frame 1202. Edges 1218 of the top plate 1208 thus extend in the x-direction and/or the y-direction in this example. Together, the edges 1218 define a perimeter 1220 of the top plate 1208. The frame 1202 also defines a perimeter 1222 in the x-direction and the y-direction. Note that the perimeter 1220 of the top plate 1208 is greater than the perimeter 1222 of the frame 1202. Thus, the frame 1202 is configured such that a perimeter 1222 of the frame 1202 is horizontally aligned within the perimeter 1220 of the top plate 1208. This thus allows for the top face 1216 to provide a larger area for force distribution and ensures that the load is distributed throughout the frame 1202.

In this embodiment, the frame 1202 is an elongated roll formed metal frame 1202. The elongated roll formed metal frame 1202 is attached to the top plate 1208 such that the elongated roll formed metal frame 1202 vertically extends below the top plate 1208. In this example, the elongated vertical passage 1204 is defined by the elongated roll formed metal frame 1202 as an elongated vertical notch 1204 configured to receive the round post 1203. The elongated vertical notch 1204 is V-shaped. In this manner, more than one segment 1224, 1226 of the elongated vertical notch 1204 makes contact with the round post 1203, which distributes the load of the round post 1203.

To help stabilize the round post 1203 installation apparatus 1200 when the post installation apparatus 1200 is standing on the ground, the post installation apparatus 1200 also includes a bottom plate 1238 attached to a bottom 1240 of the frame 1202 wherein the elongated vertical passage 1204 extends through the frame 1202 and the bottom plate 1238. Thus, the bottom plate 1238 defines a bottom opening 1242. In this manner, a segment 1239 of the post can extend below the bottom plate 1238 when the post is secured in the elongated vertical passage 1204. The elongated vertical passage 1204 and the elongated vertical opening 1206 thus extend from the top 1210 of the frame 1202, through the frame 1202, to the bottom face 1248 of the bottom plate 1238. This segment 1239 will then be installed in the ground while a segment 1249 of the post above the bottom plate 1238 remains above ground.

As shown in FIG. 12 and FIG. 13, the bottom plate 1238 is oriented along a horizontal plane 1244, which extends in the y-direction and the x-direction in this example. Thus, a top face 1246 of the bottom plate 1238 is attached to the bottom 1240 of the frame 1202 while a bottom face 1248 of the bottom plate 1238 faces away from the bottom 1240 of the frame 1202. Edges 1250 of the bottom plate 1238 thus extend in the x-direction and/or the y-direction in this example. Together, the edges 1218 define a perimeter 1252 of the bottom plate 1238. Note that the perimeter 1252 of the bottom plate 1238 is greater than the perimeter 1222 of the frame 1202. Thus, the frame 1202 is configured such that a perimeter 1222 of the frame 1202 is horizontally aligned within the perimeter 1252 of the bottom plate 1238. However, the frame 1202 is configured such that the perimeter 1252 of the bottom plate 1238 does not extend horizontally past the front vertical side 1230 but does extend horizontally past a portion 1254 of the perimeter 1222 of the frame 1202 not at the front vertical side 1230. This arrangement allows for the post installation apparatus 1200 to have the bottom plate 1238 while still allowing the post installation apparatus 1200 to secure the round post 1203, as explained in further detail below.

As shown in FIG. 12 and FIG. 13, the post installation apparatus 1200 includes one or more securement devices 1300, 1302, 1304. Each of the securement devices 1300, 1302, 1304 is configured to be positioned across the elongated vertical opening 1206 so as to secure the post to the elongated vertical passage 1204, as shown in FIG. 12 and FIG. 13. However, when there are multiple securement devices (e.g., the securement devices 1300, 1302, 1304) like in the embodiment shown in FIG. 12, the securement devices are attached at different vertical positions.

In this embodiment, the post installation apparatus 1200 includes the three securement devices 1300, 1302, 1304. However, in alternative embodiments, the post installation apparatus 1200 may include any number of the securement devices 1300, 1302, 1304. Alternative embodiments of the post installation apparatus 1200 may include any number of securement devices, like the securement devices 1300, 1302, 1304, greater or equal to one. In this embodiment, each of the securement devices 1300, 1302, 1304 is configured to be positioned across the elongated vertical opening 1206, as shown in FIG. 12 and FIG. 13, so as to secure the post in the elongated vertical passage 1204.

The securement device 1304 is attached to the frame 1202 at a vertical position 1305, which is a vertical distance D11 from the top 1210 of the frame 1202 and is vertically higher than of the securement devices 1300, 1302. In this embodiment, the securement device 1304 is fixed in position across the elongated vertical opening 1206. In this embodiment, the securement device 1304 is formed as an angle iron that has a continuous pair of plates 1306, 1308 that are connected so as to form an L shape. The plate 1306 extends parallel to the z-axis and the x-axis while the plate 1308 extends parallel to the x-axis and the y-axis. In this embodiment, the plate 1308 extends out from a top edge 1310 of the plate 1306 to form the L-shape.

In order to attach the securement device 1304 to the frame 1202, the post installation apparatus 1200 includes an arm 1312 and an arm 1314. The arm 1312 is attached to the right vertical side 1232 of the frame 1202 and the arm 1314 is attached to the left vertical side 1234 of the frame 1202. Each of the arms 1312, 1314 extend out in the direction F in front of the front vertical side 1230 of the frame 1202. The securement device 1304 is attached between the arms 1312, 1314 so as to be positioned across the elongated vertical opening 1206. The L-shape allows for the securement device 1304 to be securely welded to the arms 1312, 1314.

Referring again to FIG. 12 and FIG. 13, FIG. 13 illustrates the securement device 1300. However, it should be noted that both the securement device 1300 and the securement device 1302 have the same configuration in this embodiment. The securement devices 1300, 1302 are also configured so as to be positioned across the elongated vertical opening 1206. In this manner, the securement devices 1300, 1302 secure the post to the elongated vertical passage 1206. However, unlike the securement device 1304, the securement devices 1300, 1302 are not fixed in position. Instead, the securement devices 1300, 1302 are also positionable so as to not be positioned across the elongated vertical opening 1206. In this manner, once the post has been installed in the ground, the securement devices 1302, 1302 can be positioned so as to no longer be across the elongated vertical opening 1206. Thus, the post installation apparatus 1200 needs only to be displaced upwards by the distance D11 (since the securement device 1304 is fixed) so that the post can be removed from the elongated vertical opening 1206. The securement devices 1300, 1302 may be any type of member capable of being positioned across the elongated vertical opening 1206 and then positioned so as to not be positioned across the elongated vertical opening 1206. For example, the securement devices 1300, 1302 may be latches, pins, clasps, fasteners, screws, rivets, sliding bars, and/or the like.

The securement device 1302 is attached to the frame 1202 at a vertical position 1315, where the vertical position 1315 is lower than the vertical position 1305 of the securement device 1304 but is higher than a vertical position 1316 of the securement device 1300. Additionally, the securement device 1302 is attached to the frame 1202 at the vertical position 1316, which is lower than both vertical positions 1305, 1315. The different vertical positions 1305, 1315, 1316 are selected so that the post can be secured by the securement devices 1300, 1302, 1304. However, once the post has been installed in the ground, the securement devices 1302, 1302 can be positioned so as to no longer be across the elongated vertical opening 1206. Thus, the post installation apparatus 1200 only to be displaced vertically by the distance D11 (since the securement device 1304 is fixed to extend horizontally across the elongated vertical opening 1206) so that the post can be removed from the post installation apparatus 1200. The distance D11 should thus be selected so as to make it easy to remove the round post 1203.

It should be noted that each of the securement devices 1300, 1302, 1304 are all clamped securement devices 1300, 1302, 1304 that include clamps 1318, 1320, and 1322 respectively. The clamps 1318, 1320, 1322 each help secure the round post 1203 to the elongated vertical passage 1204.

Figure 14:
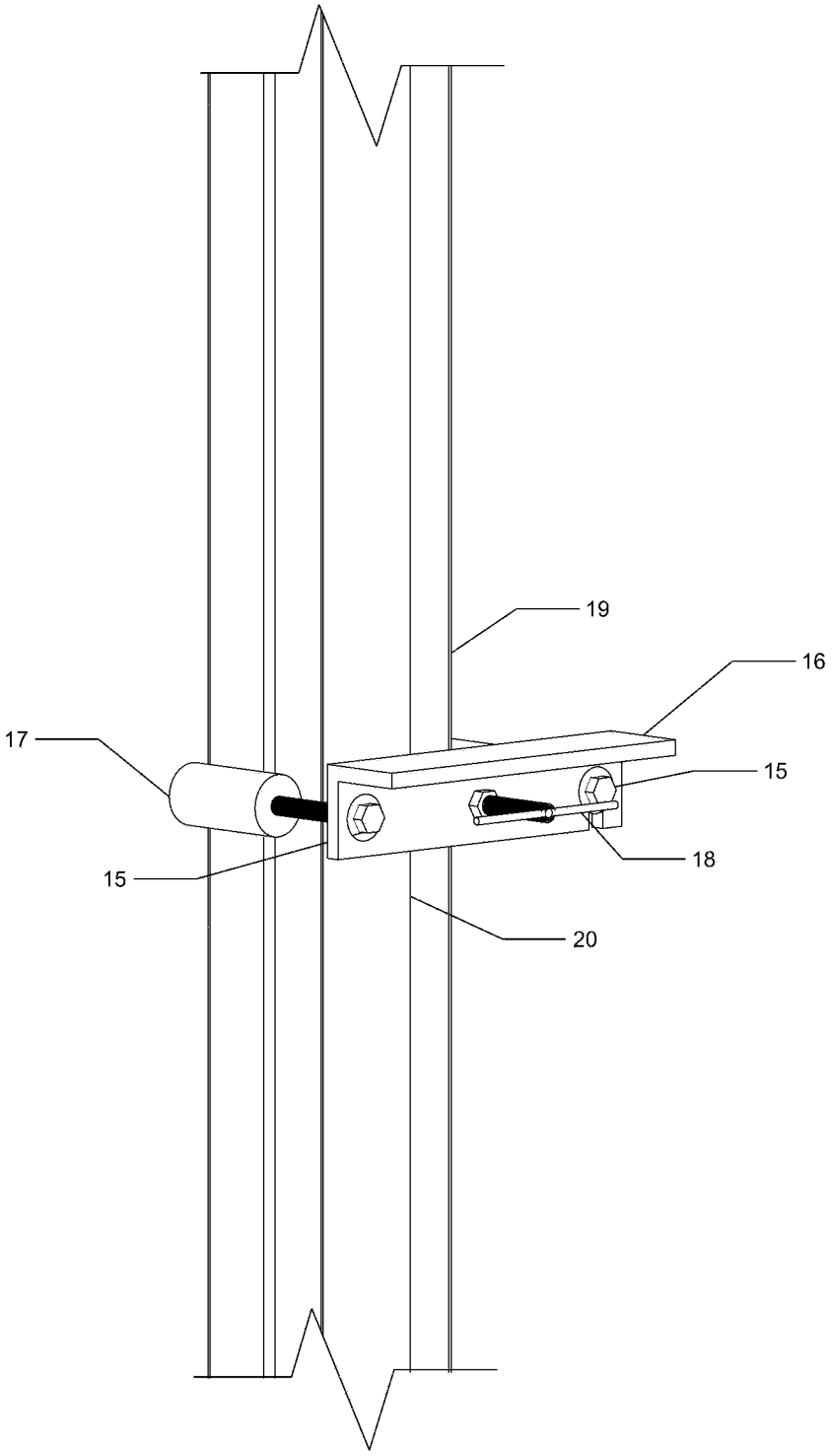
FIG. 14 is a perspective view of a clamped latch that is used as a securement device by the post installation apparatus shown in FIG. 12 and FIG. 13.

Referring now to 13 and FIG. 14, FIG. 13 and FIG. 14 illustrate one embodiment of the securement device 1300. It should be noted however that the securement device 1302 (See FIG. 12) is the same as the securement device 1300. In this embodiment, the securement devices 1300, 1302 are clamped latches 1300, 1302. It should further be noted that the operation of the clamps 1320, 1322 with respect to the securement devices 1302, 1304 is the same as the operation of the clamp 1318 (which is described herein using FIG. 13 and FIG. 14) with respect to the securement device 1300.

Referring now to 13 and FIG. 14, FIG. 13 and FIG. 14 illustrate one embodiment of the securement device 1300. It should be noted however that the securement device 1302 (See FIG. 12) is the same as the securement device 1300. In this embodiment, the securement devices 1300, 1302 are clamped latches 1300, 1302. It should further be noted that the operation of the clamps 1320, 1322 with respect to the securement devices 1302, 1304 is the same as the operation of the clamp 1318 (which is described herein using FIG. 13 and FIG. 14) with respect to the securement device 1300.

The post installation apparatus 1200 includes a pair of round bars 1400, 1402. The round bar 1400 is attached to the right vertical side 1232 of the frame 1202 while the round bar 1402 is attached to the left vertical side 1234 of the frame 1202.

A bolt 1408 is inserted through an end 1410 of the clamped latch 1300 and through the round bar 1400. In this manner, the bolt 1408 and the round bar 1400 form a hinge 1412 where the end 1410 of the clamped latch 1300 is swung about the hinge 1412. The end 1414 opposing the end 1412 has a groove 1414. Another bolt 1416 is partially inserted through the round bar 1402. In this manner, the latch 1412 is configured to be swung so that the groove 1414 receives the bolt 1416 to secure the clamped latch 1300 in the closed position.

In this embodiment, the clamped latch 1300 is formed as an angle iron that has a continuous pair of plates 1418, 1420 that are connected so as to form an L shape. The plate 1418 extends parallel to the z-axis and the x-axis while the plate 1420 extends parallel to the x-axis and the y-axis. The plate 1418 is attached by the bolt 1408 to form the hinge 1412 at the end 1410 and further forms the groove 1410. Furthermore, in this embodiment, the plate 1420 extends out from a top edge 1422 of the plate 1418 to form the L-shape. The plate 1420 can be grabbed by a user's hand so that the clamped latch 1300 can be opened and closed.

The clamp 1318 is insertable transversely through the clamped latch 1300 so that the clamp 1318 is configured to secure the round post 1203 within the elongated vertical notch 1204. In this embodiment, the clamp 1318 includes a threaded member 1424 and a clamp handle 1426. To move the threaded member 1424 toward and away from the elongated vertical notch 1204, the clamp 1318 can be twisted with the clamp handle 1426 in the counter clockwise or clockwise direction.

Figure 15:
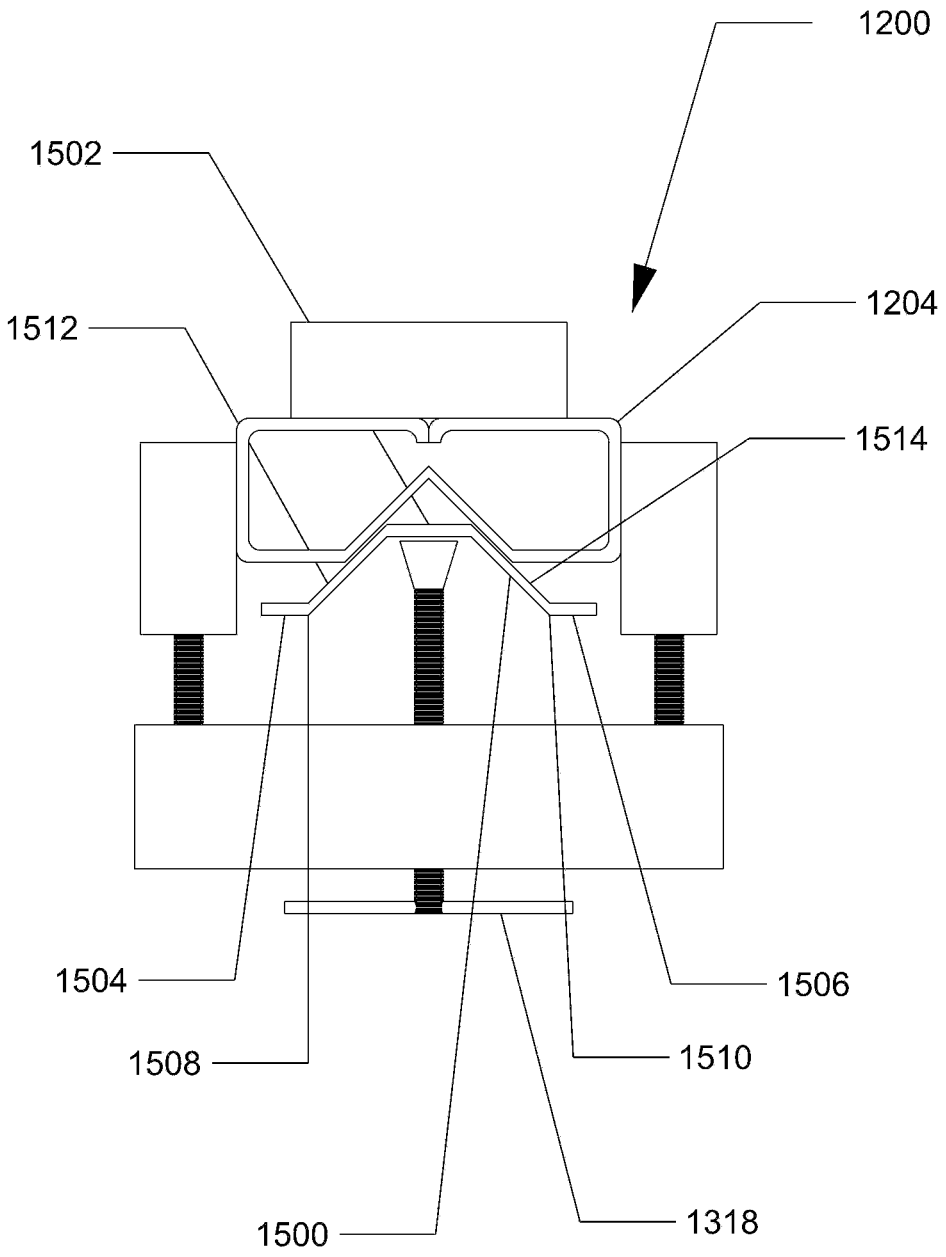
FIG. 15 is a cross sectional view of the post installation apparatus shown in FIG. 12 and FIG. 13 holding a sign post.

FIG. 15 is a cross sectional view along the x-y plane of the post installation apparatus 1200 described above with respect to FIG. 12, FIG. 13, and FIG. 15 but having a sign post 1500 secured to the elongated vertical notch 1204 (instead of the round post 1203 shown in FIG. 12, FIG. 13, FIG. 14) by the clamped latch 1300 and the clamp 1318. As shown in FIG. 15, the sign post 1500 includes a trapezoidal shaped portion 1502 with flanged sections 1504, 1506 at the ends 1508, 1510 of the trapezoidal shaped portion 1502. As shown by FIG. 15, the V-shape of the elongated vertical notch 1204 makes contact with the more than one segment 1512, 1514 of the sign post 1500, which distributes the load of the sign post 1500. Thus, the same embodiment of the post installation apparatus 1200 can be used with different types of posts, such as the round post 1203 and the sign post 1500.

Those skilled in the art will recognize improvements and modification to the preferred embodiments of the present disclosure. All such improvements and modifications are considered within the scope of the concepts disclosed herein and the claims that follow.

What is claimed is:

1. A post installation apparatus, comprising:

a frame that defines an elongated vertical passage configured to receive a post such that the post vertically extends through the elongated vertical passage when the elongated vertical passage receives the post, wherein the elongated vertical passage defines a first elongated vertical opening in the frame such that the post is removable through the first elongated vertical opening, and wherein the elongated vertical passage is substantially enclosed on at least three vertical sides;

a solid top plate attached to a top of the frame, the top plate having a top face, the top plate overhanging the post when the elongated vertical passage receives the post, and the top plate configured to transmit an external force to the post, wherein the force is generated on the top plate;

a first securement device configured to be positioned across the first elongated vertical opening so as to secure the post in the elongated vertical passage; and wherein the frame comprises a first elongated member and a second elongated member, wherein the first elongated member and the second elongated member are aligned with one another such that the spacing between the first elongated member and the second elongated member defines the elongated vertical passage and the first elongated vertical opening; and wherein the first elongated member and the second elongated member are further aligned with one another such that the spacing further defines a second elongated vertical opening one or more load bearing members attached across the second elongated vertical opening oppositely disposed from the first elongated vertical opening.

2. The post installation apparatus of claim 1, further comprising a second securement device.

3. The post installation apparatus of claim 2, wherein the second securement device comprises a second latch that is movably attached to the frame so as to be configured to swing so as to not be across the first elongated vertical opening.

4. The post installation apparatus of claim 3, wherein the first securement device and the second securement device are attached at different vertical positions to the frame.

5. The post installation apparatus of claim 1, wherein the one or more load bearing members comprise a plurality of load bearing members and wherein each of the plurality of load bearing members is attached at different vertical positions to the frame.

6. The post installation apparatus of claim 1, wherein the first securement device comprises a first latch, wherein the first latch is movably attached to the frame so as to be configured to swing across the first elongated vertical opening and so as to be configured to swing so as to not be across the first elongated vertical opening.

7. The post installation device of claim 1, wherein the frame is configured such that a first perimeter of the frame is horizontally aligned within a second perimeter of the top plate.

8. The post installation apparatus of claim 1, further comprising a bottom plate attached to a bottom of the frame wherein the elongated vertical passage extends through the frame and the bottom plate such that the bottom plate defines a bottom opening.

9. The post installation apparatus of claim 8, wherein the frame defines a front vertical side wherein the first elongated vertical opening is defined on the front vertical side and the frame is configured such that a first perimeter of the bottom plate is substantially flush with the front vertical side and extends past a portion of a second perimeter of the frame not at the front vertical side.

10. The post installation apparatus of claim 8, further comprising a frame extension that defines a second elongated vertical passage configured to receive the post such that the post vertically extends through the second elongated vertical passage when the second elongated vertical passage receives the post, wherein:

the frame extension comprises a frame segment, a top plate attached to a top of the frame segment and a second bottom plate attached to a bottom of the frame segment wherein the second elongated vertical passage extends vertically through the top plate of the frame extension, the frame segment, and the second bottom plate;

the top plate of the frame extension is removeably attachable to the bottom plate that is attached to the frame such that the second elongated vertical passage integrates with the elongated vertical passage so as to extend a height of the elongated vertical passage when the top plate of the frame extension is attached to the bottom plate.

11. The post installation apparatus of claim 1, further comprising a frame extension that defines a second elongated vertical passage, wherein the frame extension is removeably couplable to the frame such that the second elongated vertical passage integrates with the elongated vertical passage so as to extend a height of the elongated vertical passage when the frame extension is coupled to the frame.

12. The post installation apparatus of claim 1, wherein the frame comprises an elongated roll formed metal frame, wherein the elongated roll formed metal frame defines an elongated vertical notch as the elongated vertical passage.

13. The post installation apparatus of claim 12, wherein the elongated vertical notch is V-shaped.

14. The post installation apparatus of claim 12, further comprising a clamp, wherein:

the first securement device comprises a first latch, wherein the first latch is movably attached to the frame so as to be configured to swing across the first elongated vertical opening and so as to be configured to swing so as to not be across the first elongated vertical opening;

the clamp being insertable transversely through the first latch so that the clamp is configured to secure the post within the elongated vertical notch.

15. The post installation apparatus of claim 1, further comprising a clamp, wherein:

the first securement device comprises a first latch, wherein the first latch is movably attached to the frame so as to be configured to swing across the first elongated vertical opening and so as to be configured to swing so as to not be across the first elongated vertical opening;

the clamp being insertable transversely through the first latch so that the clamp is configured to secure the post within the elongated vertical passage.

16. The post installation apparatus of claim 1, wherein the first securement device comprises a removably pin, wherein the removable pin is removeably attachable to the frame such that the removable pin extends across the first elongated vertical opening.

17. The post installation apparatus of claim 1, wherein the frame that defines the elongated vertical passage is configured to receive the post such that the post is selectable from a group consisting of a T-post, a round post, or a sign post.

18. A post installation apparatus, comprising:

a frame that defines an elongated vertical passage configured to receive a post such that the post vertically extends through the elongated vertical passage when the elongated vertical passage receives the post, wherein the elongated vertical passage defines a first elongated vertical opening in the frame such that the post is removable through the first elongated vertical opening, and wherein the elongated vertical passage is substantially enclosed on at least three vertical sides;

a solid top plate attached to a top of the frame, the top plate having a top face, the top plate overhanging the post when the elongated vertical passage receives the post, and the top plate configured to transmit an external force to the post, wherein the force is generated on the top plate;

a first securement device configured to be positioned across the first elongated vertical opening so as to secure the post in the elongated vertical passage; and a second securement device, wherein the second securement device comprises a second latch that is movably attached to the frame so as to be configured to swing so as to not be across the first elongated vertical opening, wherein the first securement device and the second securement device are attached at a different vertical positions to the frame.

19. The post installation apparatus of claim 18, further comprising a bottom plate attached to a bottom of the frame wherein the elongated vertical passage extends through the frame and the bottom plate such that the bottom plate defines a bottom opening.

20. The post installation apparatus of claim 18, wherein the frame comprises an elongated roll formed metal frame, wherein the elongated roll formed metal frame defines an elongated vertical notch as the elongated vertical passage.

* * * * *